US011279598B2

(12) United States Patent
Narcisco

(10) Patent No.: US 11,279,598 B2
(45) Date of Patent: Mar. 22, 2022

(54) PORTABLE DERRICK SYSTEM, APPARATUS AND METHODS

(71) Applicant: Michael Narcisco, Bronx, NY (US)

(72) Inventor: Michael Narcisco, Bronx, NY (US)

(73) Assignee: Dun-Rite Hoisting LLC, Bronx, NY (US)

( * ) Notice: Subject to any disclaimer, the term of this patent is extended or adjusted under 35 U.S.C. 154(b) by 48 days.

(21) Appl. No.: 16/839,481

(22) Filed: Apr. 3, 2020

(65) Prior Publication Data

US 2020/0231416 A1 Jul. 23, 2020

Related U.S. Application Data

(63) Continuation of application No. 16/152,112, filed on Oct. 4, 2018, now abandoned, which is a continuation of application No. 15/784,969, filed on Oct. 16, 2017, now abandoned, which is a continuation of application No. 14/844,981, filed on Sep. 3, 2015, now abandoned, which is a continuation of application No. 13/881,860, filed as application No. PCT/US2011/058198 on Oct. 28, 2011, now abandoned.

(60) Provisional application No. 61/455,903, filed on Oct. 28, 2010.

(51) Int. Cl.
*B66C 23/20* (2006.01)
*B66C 23/16* (2006.01)

(52) U.S. Cl.
CPC ..... *B66C 23/205* (2013.01); *B66C 23/166* (2013.01)

(58) Field of Classification Search
CPC ..... B66C 23/205; B66C 23/166; B66C 23/04; B66C 23/06; B66C 23/16; B66C 23/26; B66C 23/365
USPC ..... 212/179, 175–177
See application file for complete search history.

(56) References Cited

U.S. PATENT DOCUMENTS 2,013,690 A * 9/1935 Lamond ..... B63B 27/04 212/278
2,591,974 A * 4/1952 Smith ..... B66C 23/205 212/223
3,326,391 A * 6/1967 Adolfsson ..... B66C 23/706 212/261
3,521,860 A * 7/1970 Zehrung Jr. ..... B66C 23/48 254/8 R
3,671,015 A * 6/1972 Sullivan ..... B66C 23/205 254/332

(Continued)

*Primary Examiner* — Michael R Mansen
*Assistant Examiner* — Juan J Campos, Jr.
(74) *Attorney, Agent, or Firm* — Sutton Magidoff Barkume LLP

(57) ABSTRACT

A portable derrick system for use in hoisting and lowering loads at a plurality of job sites, comprising, in combination: a boom subassembly, a boom head subassembly, a mast support subassembly, a mast head subassembly, a load-carrying line, a winch capable of cooperating with said line, power means for driving the winch, means for pivoting the boom assembly, means for controlling said pivoting means, the foregoing elements of the invention capable of being transported by humans to elevated positions such as, without limitation, rooftops and terraces, and wherein the aforementioned are capable of repeated assembly and disassembly at a plurality of job sites and serving to facilitate the elimination of the need for a street-level crane.

8 Claims, 48 Drawing Sheets

(56) References Cited

U.S. PATENT DOCUMENTS

| | | | | |
|---|---|---|---|---|
| 4,090,625 | A * | 5/1978 | Walters | B66C 23/48 414/743 |
| 4,700,851 | A * | 10/1987 | Reeve | B66C 23/36 212/175 |
| 2006/0163186 | A1 * | 7/2006 | Choate | B66C 23/166 212/175 |

* cited by examiner

PORTABLE DERRICK SYSTEM, APPARATUS AND METHODS

INTRODUCTION

The present invention relates generally to the hoisting (lifting) and lowering of objects between relatively higher and lower elevations, and more specifically to a novel and efficient portable derrick system, apparatus and method of hoisting and lowering any of a variety of objects to, for example, the roofs (sometimes spelled "rooves") of buildings. The derrick system according to this invention can be moved to and from any variety of locations and can be assembled and disassembled, for use in jobs currently utilizing street cranes, in which a myriad of problems abound.

PRIOR & EXISTING STATE OF THE ART PROBLEMS

Overcome with the Use of The Present Invention:

The portable derrick system according to the present invention, in a number of embodiments, virtually eliminates prior art and existing state of the art problems and recurring aggravating "headaches" encountered in major heavily-regulated cities such as New York. These problems include those associated with the use of cranes at street level.

There has long been a significant need for better and more cost and time efficient methods of hoisting and lowering of heavy objects to and from relatively elevated and lower elevations, such as locations in and/or on buildings. Such locations often include roofs, terraces, penthouses, decks, balconies, and windows of building floors above street level. As used throughout this specification, the terms lifting, hoisting, elevating, raising, and the like, can be read as synonymous, without departing from the spirit and meaning of my invention.

There are private consumer and commercial customers whose needs include the hoisting and/or lowering of, without limitation and by way of example only, art (paintings, sculptures), pianos, furniture, air conditioners, steel, heat exchangers, telecommunication equipment and installations, water tower components, solar panels, green-energy elements, heavy construction materials, and garden elements and materials, to terraces, rooftops, balconies, upper floor windows. In major cities such as New York City, specialized riggers such as Dun-Rite Specialized, LLC of Bronx, N.Y., have historically provided high quality services which include the foregoing. In the past, without the benefits of the present portable derrick system invention, cranes have been used. As used throughout this specification, the term "rigger" (which term has nautical origins relating to masts, sails and yards of a sailing vessel) is meant to designate a present-day party who, utilizing systems of ropes, chains, tackle, supports and other equipment, supports, hoists, and lowers physical articles and apparatus.

The examples of hoisting loads set forth above often involve load weights of less than two thousand (2000) pounds and, thus, fall within the purview of one or more embodiments of the present invention described below, in conjunction with the annexed drawings and photographs. It is important to state here that, while specific embodiments are disclosed herein which are directed to the hoisting of loads weighing less than 2000 pounds, the present invention is scalable upwardly so as to be able to lift many load weight classes far greater than one ton.

By way of example only, parties requiring the lifting of objects (such as, by way of example only, an air conditioner or piano), which weigh less than two thousand (2000) pounds, to a roof, upper-floor window, or terrace of a multiple dwelling or commercial building, face many hurdles, costs, issues of time and delays, and other difficulties. These hurdles and difficulties can be measured in lost monies, time, energy—all of which add to the overall cost of the task. And these losses, by their very nature, are anti-"green" to those focused upon preserving energy and protecting the environment. Furthermore, while a number of private individuals are wealthy enough to purchase art and other such objects, and to be able to afford their being hoisted to elevated apartments such as penthouses, at some point, the aggravation, costs and lost time factors will outweigh the benefits in the minds of such individuals and they may or will abandon their desire to do such hoisting.

With the portable derrick system of the present invention, its component parts are delivered to a job site by truck, carried by elevator to the highest elevator landing, walked up the remaining steps to the rooftop (for example), and assembled on the rooftop. An operator who controls the hydraulics and motor lowers the hook to street level where personnel attach the load to be hoisted, and the load is hoisted up to and above rooftop wall level. The boom is then swiveled or rotated (manually or by means of a pinion drive gear interacting with a slew gear) such that the load overlies the spot on the rooftop where it will come to rest, and the load is lowered to that spot and unhooked. Multiple hoists are easily facilitated. When the job is complete, the components of the portable derrick system of the invention are disassembled for re-assembly at the next site or for return to the rigger's place of business. It is intended that the portable derrick may be used any number of times, such that its life extends over many jobs.

The present invention provides a system capable of lifting and lowering loads of less than 2000 pounds without the need of a street crane, in major cities abundant with street crane regulations such as New York, as well as systems that are "scaled up" to be able to handle far greater loads. While the example illustrated in the present patent specification is direct to the sub-2000-pound load limit, the present invention contemplates many different capacities without departing from the concept disclosed herein.

It should be noted that I have chosen a title of the present invention which includes the terms "system", "apparatus" and "method" for at least one important reason. The scope of the present invention envisions one or more systems which may comprise variations in components and constituent hardware, and the business and systems' functioning are novel and unique when compared to known prior art.

Examples of Crane Problems:

Hypothetical Crane Example: Assume for purposes of this illustration a rigger hired in New York City (this illustration is not meant to limit the scope and usefulness of the present invention in many other locations) to hoist an air conditioner to the roof of a commercial building wishes to use a street-level crane, and that the boom length is greater than 250 feet, as normally measured from the center pin of the crane to the boom head. In no particular chronological order, this rigger will be required to do the following on this job, without the benefit of the present portable derrick system invention:

- The services of a professional engineer will be required to specify the placement and setup of the crane.
- If the professional engineer is one of the top in his (the use of "his" in this specification is meant to embody "his" and "her", without discrimination intended), there will be time required to engage the engineer, paperwork and signatures (paper or electronic) associated with his engagement, his time to study the job drawings and specifications, his creative thought time, his time to convey his thoughts to his client (the rigger), and there may be delays because of prior commitments made for and his being busy with unrelated jobs. All of this can come under the "time" factor.

An application must be prepared, reviewed and submitted to the New York City

Department of Buildings, Cranes and Derricks Division, for a crane operation permit.

There will be a waiting period from the time of this application submission and the time of issuance of a permit, assuming that the permit is readily issued without questions or modifications required to the application. This waiting period can run into weeks. If the load to be hoisted is a replacement air conditioning unit, imagine the discomfort of the tenants during Summer months without their building having a functioning air conditioning unit.

New York City's Department of Transportation ("DOT"), as the governmental issuing authority, issues street permits for the placement of cranes on its streets. An application must be prepared, reviewed and submitted for the street permit, and time allotted for comment, modification if required, and issuance.

Pedestrian traffic along streets with cranes operating will be impacted and re-routing and sidewalk closures are usual.

Traffic lanes are closed to accommodate crane setup and operation. In some jobs, 2 or 3 lanes may be closed to traffic.

Full or partial street closures are encountered with cranes.

Even where there will only be a partial closure of the street during operation of the crane, a full closure of such a street may be required for crane setup and breakdown.

The DOT permit has a specific time window that is specified. If work is not accomplished within that time window, the permit will expire and a re-application process will be required.

Application for a DOT permit may occur months before the crane will be setup and used.

While one cannot apply too early, in theory, there will be a certain amount of educated guesswork and a possible conflict regarding the actual delivery date that the load will arrive at the jobsite for hoisting, and the permit time window. This may require or result in the need for a permit re-application.

If the work site is located over rail lines such as the Subway in New York City, the New York Metropolitan Transit Authority ("MTA") must be petitioned for a permit authorizing this work. Typically, a professional engineer will prepare and file such an application. If the professional engineer helping the rigger is not the same professional engineer at a new building site, for example, all of the engagement, education, etc. steps described herein must be accomplished with the new professional engineer. If the professional engineer is one and the same person, he/she will already have the building's plans and specifications.

The MTA requirement identified above may take months, and may vary upon the time of year. It should be noted that where a crane is utilized with a boom greater than 250 feet in length, the MTA must send out at least one inspector to the job site. In the case of operating a crane over the NYC Subway, it would not be unusual to have to close one or more Subway access or entry points.

The MTA activities described above will also involve the cost of an insurance premium for an MTA-related insurance policy, and the MTA normally charges the rigging company a daily rate, per day, per individual inspector, for the inspectors at the job site.

The application for street closure may take months before the actual lifting is accomplished. Different actual waiting times are often encountered for different parts of cities.

There will be a need for the posting of full closure signs at least 7 days prior to the start of the crane job.

Flag personnel are required and are usually hired by the rigger, to attend to the ends of the street that is closed.

Fully closed streets often include commercial businesses such as parking garages and retail establishments which require vehicular access. These businesses are invariably negatively impacted as a result of street closure and changes in pedestrian traffic patterns.

Barricades are required at the ends of fully closed streets, to prevent unauthorized vehicular traffic. They must be moved and replaced to allow for authorized traffic.

Once a crane is set up, it is not practical to move it, should there be an error in placement or a change in circumstances, for whatever reasons.

Operation of the crane will be limited to certain days of the week or weekend, thereby eliminating many normal work days.

Where the crane is operated on weekends, overtime pay for personnel will be required.

If there is a school or child playground on a street where a crane is to be operated, there will be circumstances where work will not be allowed during school hours, for safety reasons.

If there is a Fire Department fire house on the block that will be closed, there are special needs required not to interfere with their timely response to alarms.

Surface public transportation, such as buses and rail systems (in cities where present), will be adversely impacted.

Bicycle lanes will often be impacted on streets closed for crane setup and operation.

New York City, as an example only, survives only because of the use of trucks to make deliveries and remove trash. Street closures negatively affect the closed streets as well as other streets to which traffic is re-routed and increased. Deliveries and delivery times are directly negatively affected.

New York City is not serviced by light or heavy rail, as is the case with other cities. It is believed to be the only major city without direct main highway access. For these reasons alone, street closures due to the setup and operation of cranes can greatly negatively impact truck and vehicular traffic. This is aggravated in New York as a result of growing designations of pedestrian plazas, bike lanes and seating areas that previously were used by vehicles.

New York City has seen its share of crane-related accidents, in some instances involving impermissible placement, setup and operation of a crane. As a result, the NYC DOT (a different group within this agency than that associated with the processing of applications for and issuance of permits) has become more intensely involved in supervising this activity, to reduce the threat of such accidents. This adds time to the entire crane process.

There are travel permits required to move a crane to and from a job site.

Local community boards must be contacted, as a practical matter, and involved and educated with respect to street closure and crane setup and operation.

Religious groups who observe holidays that conflict with crane setup and operation will have a voice and may slow or delay the crane process.

Coop boards will likewise require "hand-holding" where their coop rules deny commercial types of access or activities on weekends or other days set aside for crane setup and operation.

Every governmental authority and impacted private and consumer group has the power (if not the right) to stop or delay a crane job.

It goes without saying that the placement, setup, operation, breakdown, and movement of cranes to and from job sites adds an element of safety which, if it can be avoided, will benefit those directly affected at the crane job site as well as the public at large.

SEVERAL OBJECTS OF THE PRESENT INVENTION

It is an object of the present invention to provide a portable derrick system capable of being repeatedly assembled and disassembled at a plurality of job sites.

Another object of the present invention is to eliminate the use of street cranes when lifting and/or lowering loads of less than 2000 pounds.

A further object of the present invention is to provide such a portable derrick system which enjoys features including its being relatively light weight, free standing and counter weighted.

Yet another object of my invention is to provide such a portable derrick system which helps avoid damage, wear and tear to state, local, and interstate highways, bridges roadways and streets. It should be noted that while interstate highways have been designed for carrying military vehicles and equipment, the weight of present day cranes have the potential to damage and/or affect the life of highway surfaces.

A further object of my invention is to provide a system, as disclosed, which eliminates slow-moving traffic, traffic jams and congestion on roadways and highways on which cranes are currently transported, due to the relatively slow speeds associated with such transporting of cranes.

Still another object is to provide a portable derrick system which has no invasive impact upon roofs, terraces, decks, balconies or bulkheads.

Yet a further object of the present invention is to provide such a system which allows for front and rear hoisting on many elevated (such as rooftop) locations, which is not physically possible utilizing a crane, which exerts unacceptable magnitudes of pressure on elevated structure surfaces (such as an elevated parking garage) on which a crane must be supported.

A further object of the present invention is to provide a portable derrick system with a relatively small base footprint area, which also facilitates movement of the derrick.

It is another object of the present invention to eliminate current state of the art mandates for partial and/or full street closures for weekends or nights only.

Still another object of this invention is to provide a portable derrick system which meets the requirements of governmental regulations such as, without limitation, New York City's Department of Buildings ("DOB") Code #RS 19-2 Power Operated Cranes and Derricks.

A further object of the present invention is to eliminate the time and cost burdens associated with obtaining and maintaining current governmental permits.

Yet a further object of the present invention is to provide a user of my portable derrick system with the ability to work during normal Monday-Friday working hours at straight time pay rates and without the need for overtime pay rates.

Still another object of the present invention is to eliminate the time and cost burdens associated with the use of cranes and crane engineering with picks above 250 feet.

A further object of this invention is to provide a portable derrick system with greatly minimized mobilization time and costs when compared to the use of street cranes, by being able to install the present invention at the work site for the entire or a major portion of the length of the job.

The previous object of the present invention is facilitated with a portable derrick system where hoisting of materials can be done as the job requires and as material becomes available, or as spacing needs allow.

Still a further object of the present portable derrick system invention is to provide same to eliminate logistical problems relating to shipping, receiving and/or storing material on or at job sites.

Another object, given the elimination of the use of a street crane, is to eliminate the current coordination requirement and problem where the crane must be met within time windows at the job site, thereby eliminating the factor of limiting the hoisting permit availability window associated with cranes.

A further object of the present invention is to virtually eliminate the problem of crane availability and permit re-filing costs in monies and time during inclement weather, such as high winds, heavy rain, or snow conditions, or where one runs up against governmental crane embargo periods.

A yet further object of the present invention is to provide the aforesaid portable derrick system for the lifting and lowering of art object, pianos, furniture, air conditioner and other building-associated equipment, steel, cell sites and telecommunications apparatus, water tower elements, solar panels, heat exchangers, heavy construction materials, and garden elements for rooftops, penthouses, balconies and terraces.

BRIEF DESCRIPTION OF THE DRAWINGS/FIGURES

FIGS. 1A-1I are presented to illustrate the prior art and associated problems with the prior art.

FIG. 1A is a photograph taken near the middle of $56^{th}$ Street between $2^{nd}$ and $3^{rd}$ Avenues, Manhattan, N.Y., looking West, and illustrating a full closure of this highly traveled commercial street, in which a street crane is being set up prior to being raised;

FIG. 1B is a photograph of the street crane referred to in FIG. 1A;

FIG. 1C is another photograph corresponding to FIG. 1A taken near the middle of $56^{th}$ Street between $2^{nd}$ and $3^{rd}$ Avenues, Manhattan, N.Y., looking West, and illustrating a full closure of this highly traveled commercial street, in which a street crane is being set up;

FIG. 1D is another photograph corresponding to FIG. 1A taken near the middle of $56^{th}$ Street between $2^{nd}$ and $3^{rd}$ Avenues, Manhattan, N.Y., looking West, and illustrating a full closure of this highly traveled commercial street, in which a street crane is being set up;

FIG. 1E is another photograph corresponding to FIG. 1A taken near the middle of 56$^{th}$ Street between 2$^{nd}$ and 3$^{rd}$ Avenues, Manhattan, N.Y., looking East, and illustrating a full closure of this highly traveled commercial street, in which a street crane is being set up;

FIG. 1F is another photograph corresponding to FIG. 1A taken near the middle of 56$^{th}$ Street between 2$^{nd}$ and 3$^{rd}$ Avenues, Manhattan, N.Y., looking East, and illustrating a full closure of this highly traveled commercial street, in which a street crane is being set up;

FIG. 1G is another photograph corresponding to FIG. 1A taken close to Third Avenue on 56$^{th}$ Street between 2$^{nd}$ and 3$^{rd}$ Avenues, Manhattan, N.Y., looking West, and illustrating the placement of barricades used to effect the full closure of this highly traveled commercial street, in which a street crane is being set up;

FIG. 1H is another photograph corresponding to FIG. 1A taken adjacent the crosswalk at the East side of to Third Avenue on 56$^{th}$ Street between 2$^{nd}$ and 3$^{rd}$ Avenues, Manhattan, N.Y., looking Northwest, and illustrating the placement of barricades used to effect the full closure of this highly traveled commercial street;

FIG. 1I is another photograph corresponding to FIG. 1A taken from the Southwest corner of Third Avenue and 56$^{th}$ Street, Manhattan, N.Y., looking East, and illustrating the closed off street in which a street crane is being set up;

DESCRIPTION OF THE PREFERRED EMBODIMENTS

Discussion:

The present invention overcomes each and every problem mentioned above associated with the use of cranes by making the street-level crane completely unnecessary. These problems evaporate when a rigger uses the portable derrick system according to the present invention.

Turning now to the drawings (and photographs), the first several designated FIGS. 1A through 1I, embedded within this specification, are presented as a "capture" of a real-world street-level crane setup in progress. FIGS. 1A through 11 represent the existing state of the art and do not represent the present portable derrick system invention.

FIGS. 1 through 37 illustrate embodiments of the present invention in a number of respects. It should be noted that a number of photographs illustrate an earlier embodiment of the present invention wherein physical labor of personnel is required to swivel the boom head from over the sidewalk or street to a position over the roof. A later embodiment of my invention incorporates a pinion gear motor which drives a slew or turntable horizontal gear, thereby doing away with the need for 2 men to do this turning or swiveling, and making the task that much easier.

Figure 1:
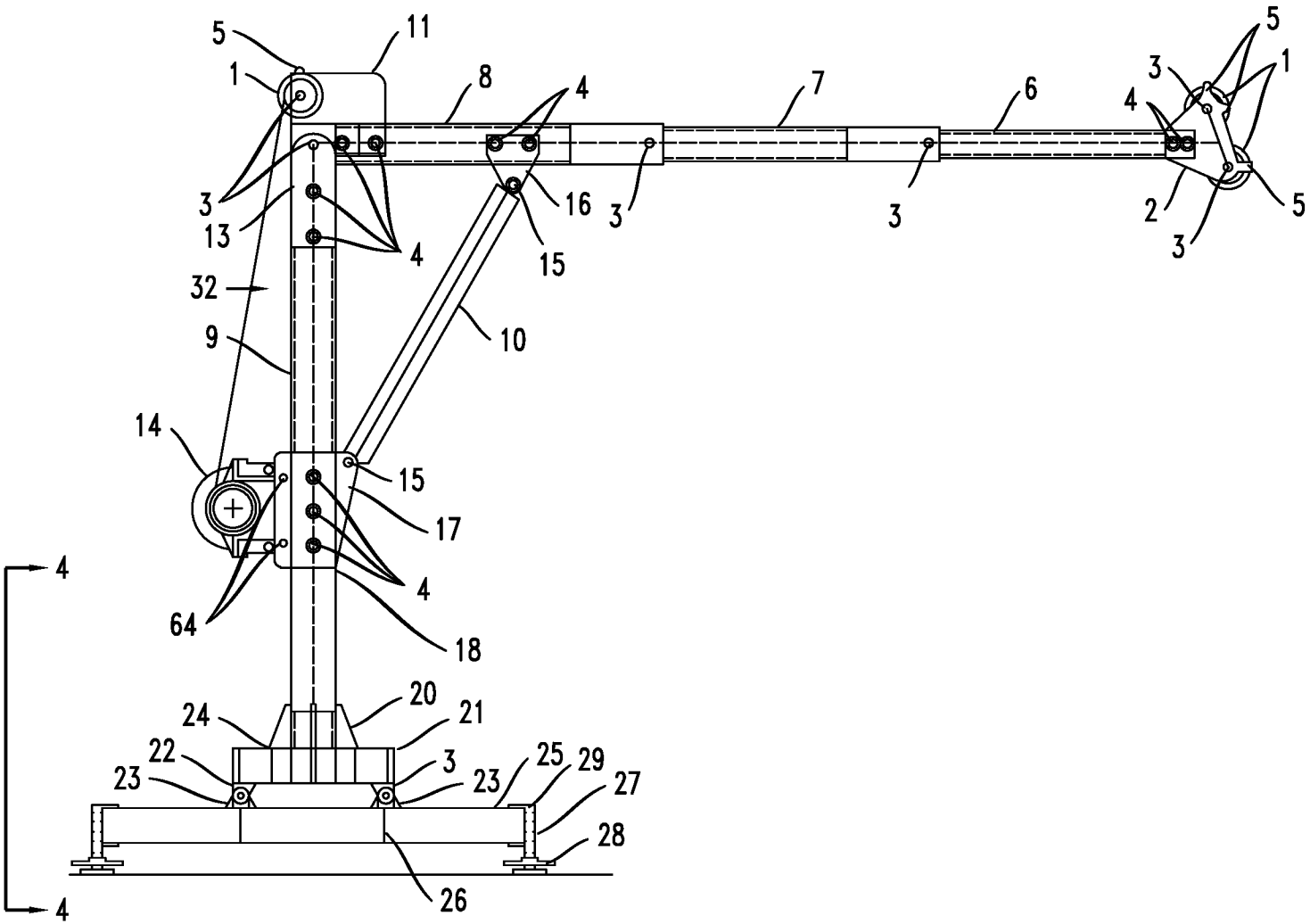
FIG. 1 is an elevation view of an assembled embodiment of the portable derrick system according to the present invention.
Figure 1A:
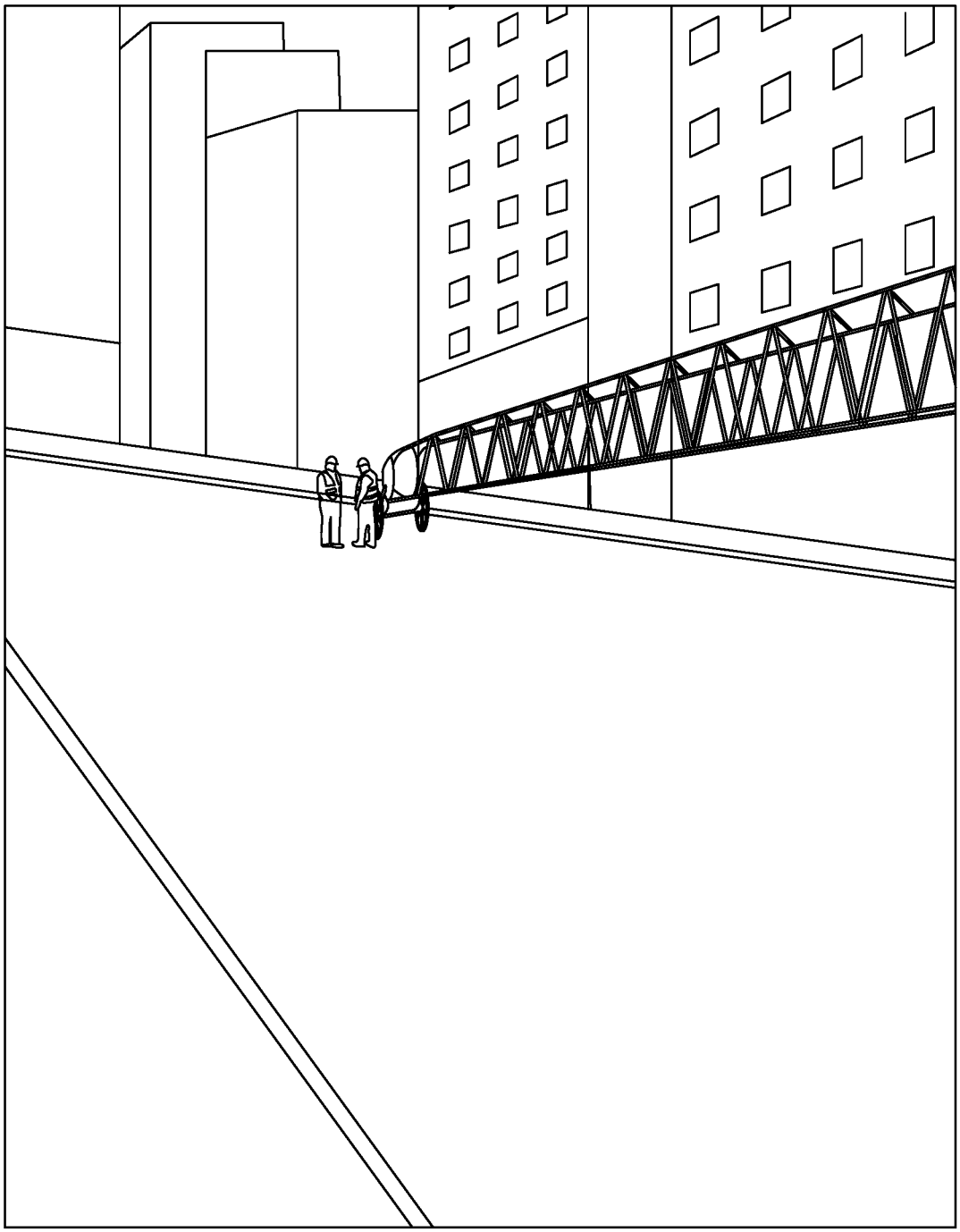
Figure 1B:
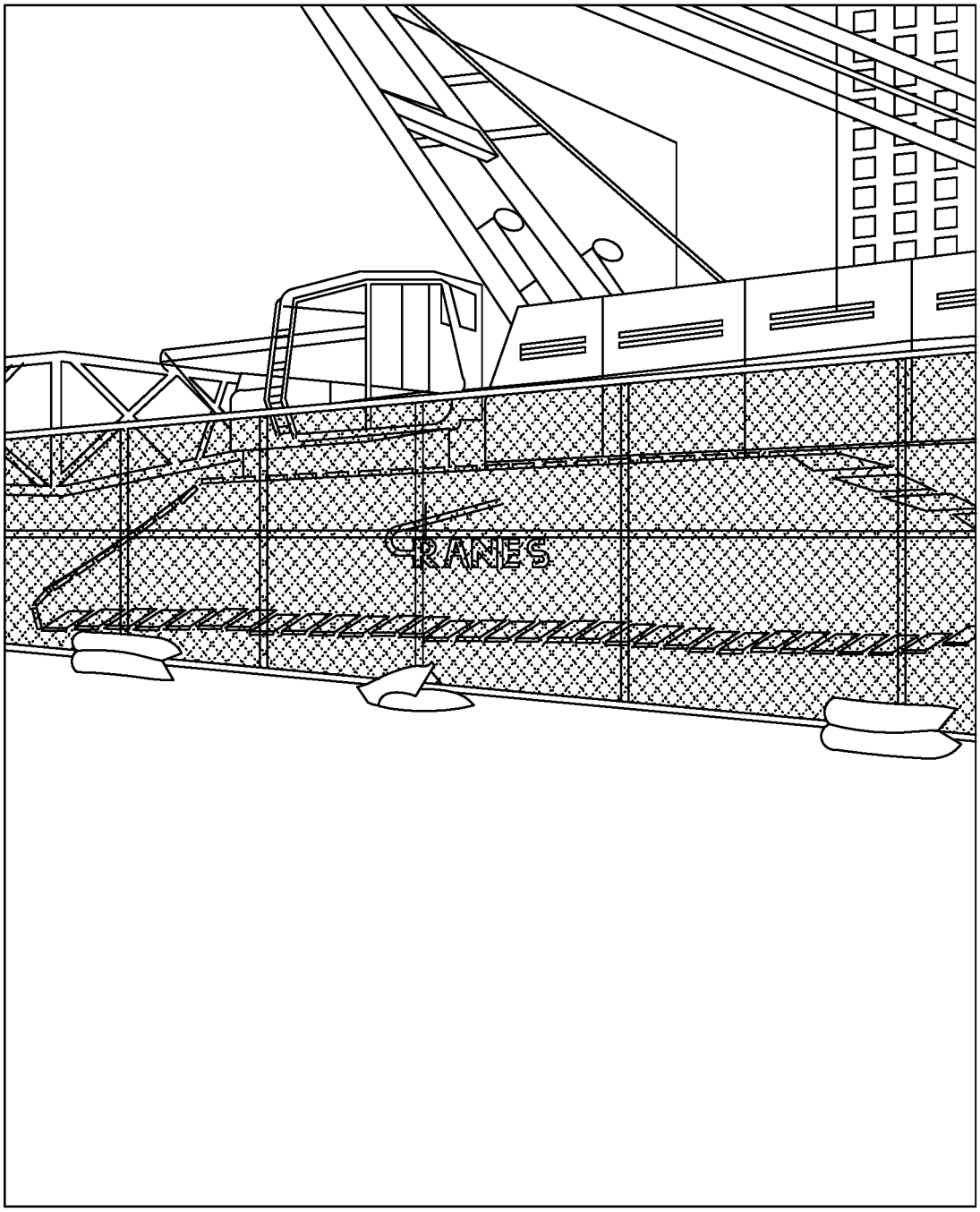
Figure 1C:
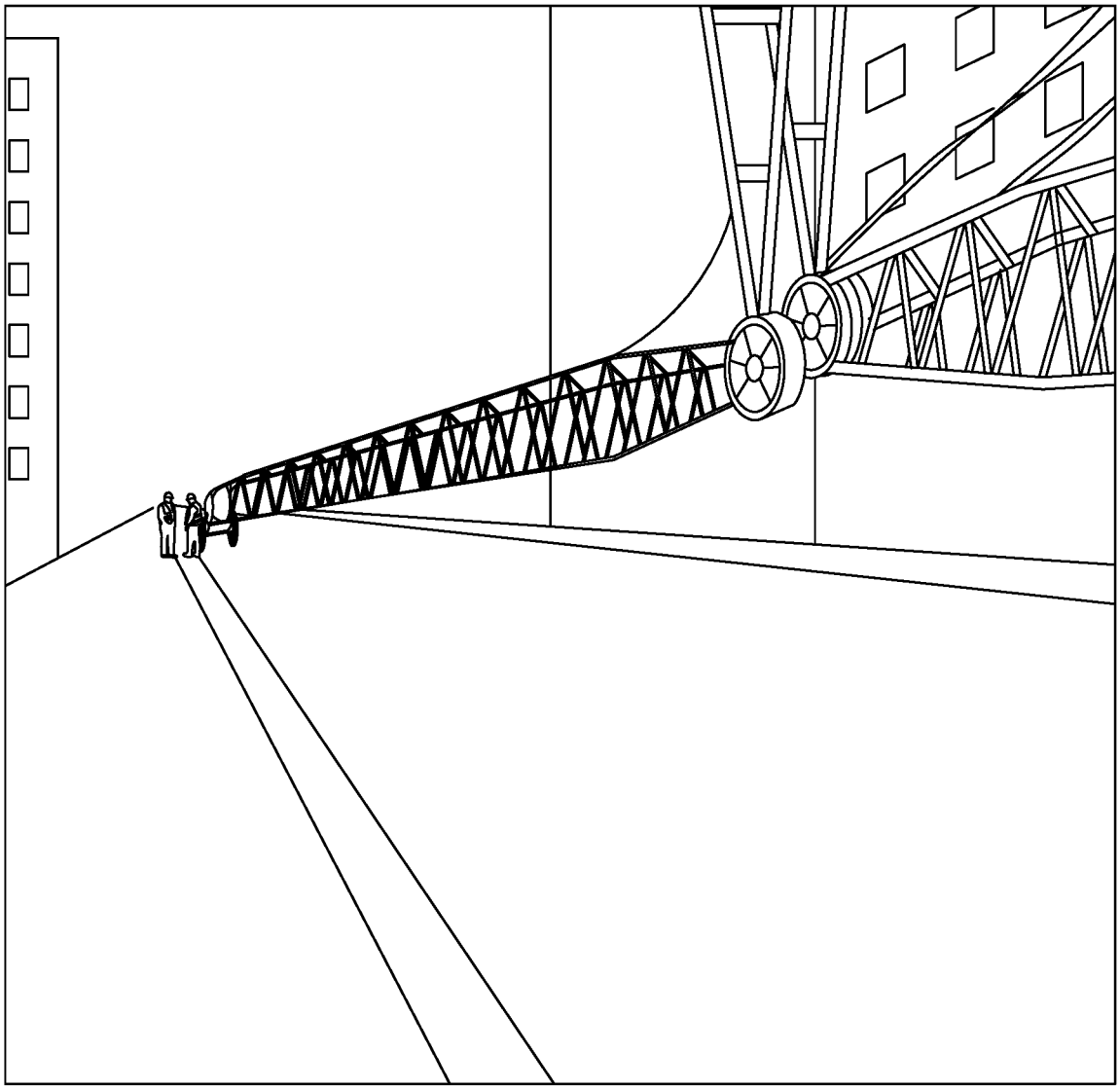
Figure 1D:
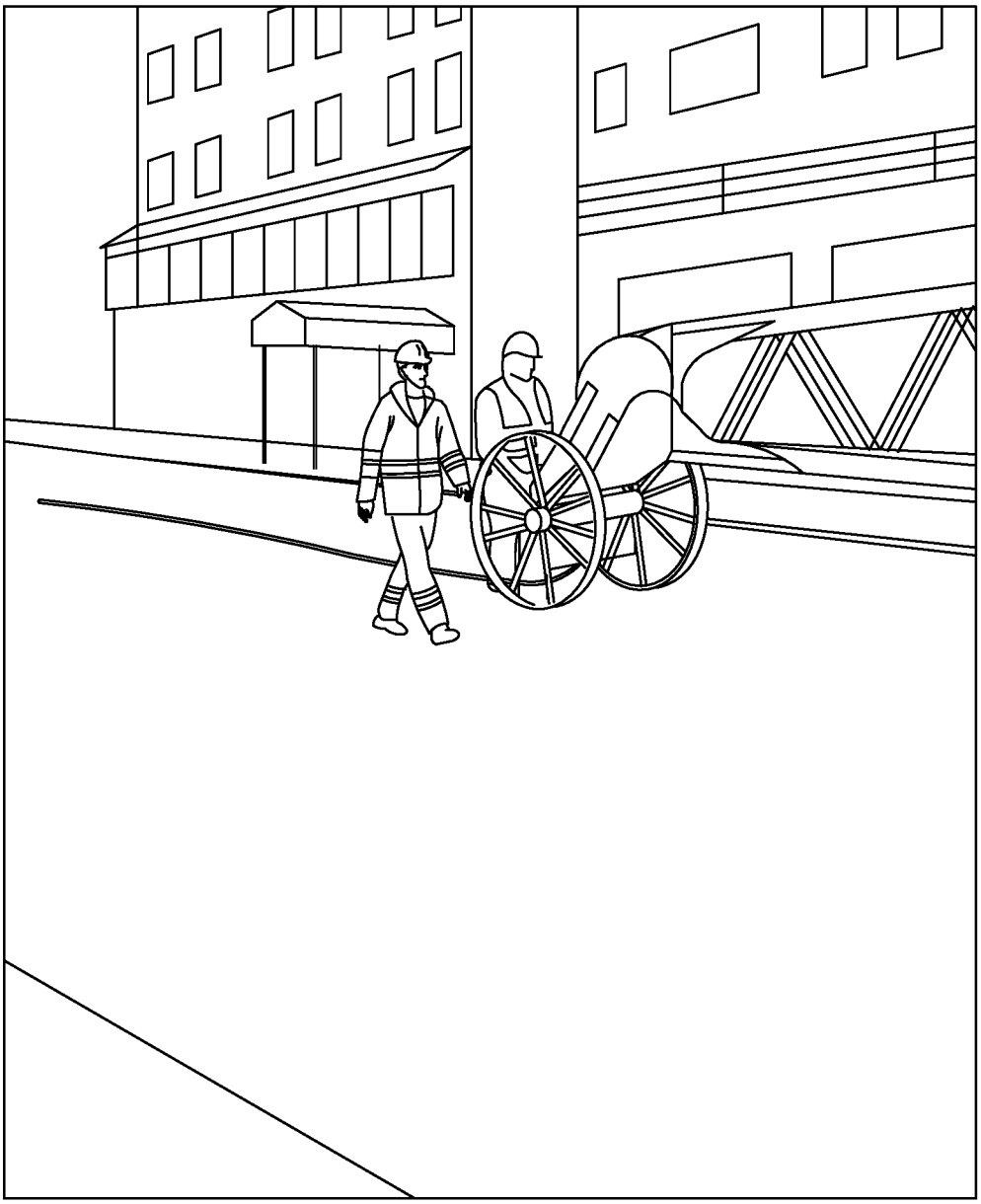
Figure 1E:
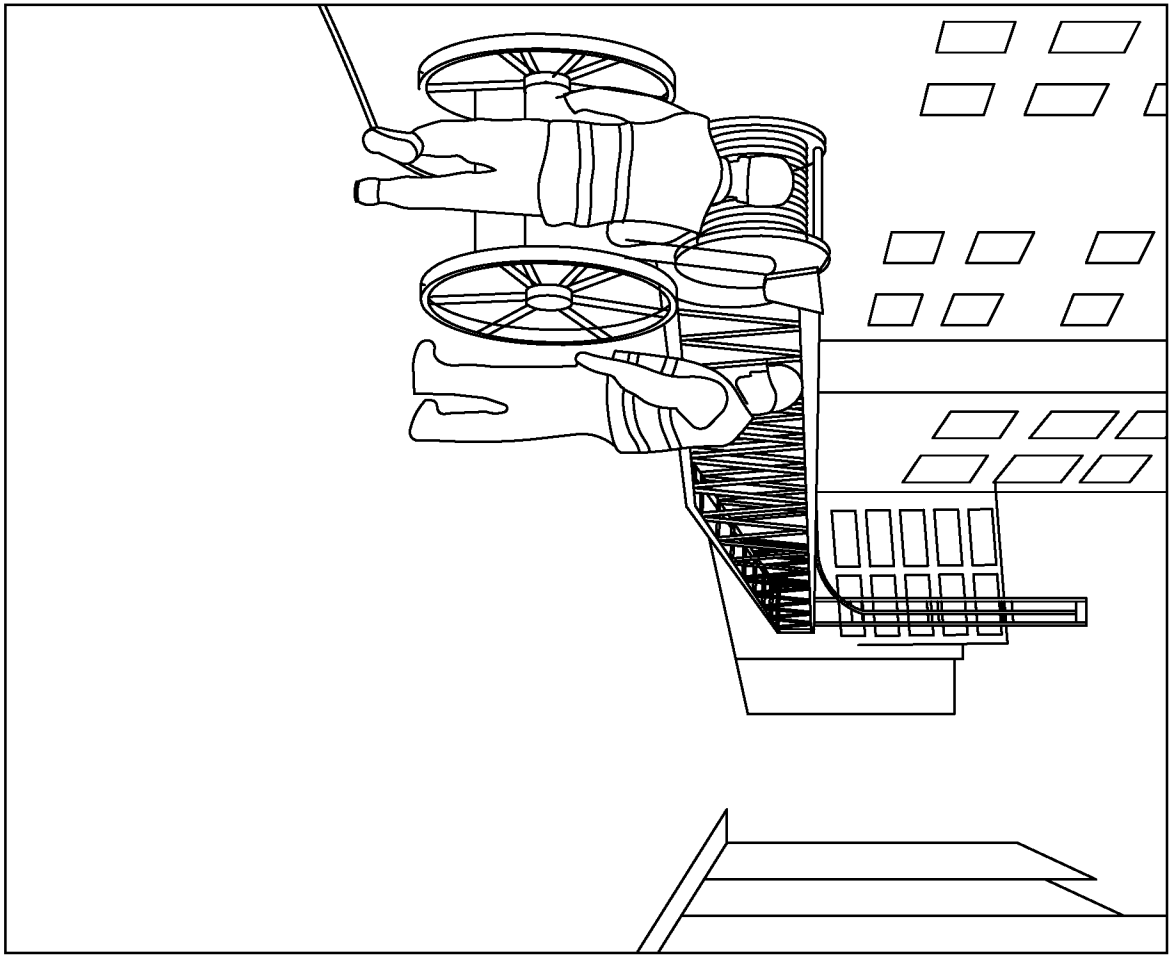
Figure 1F:
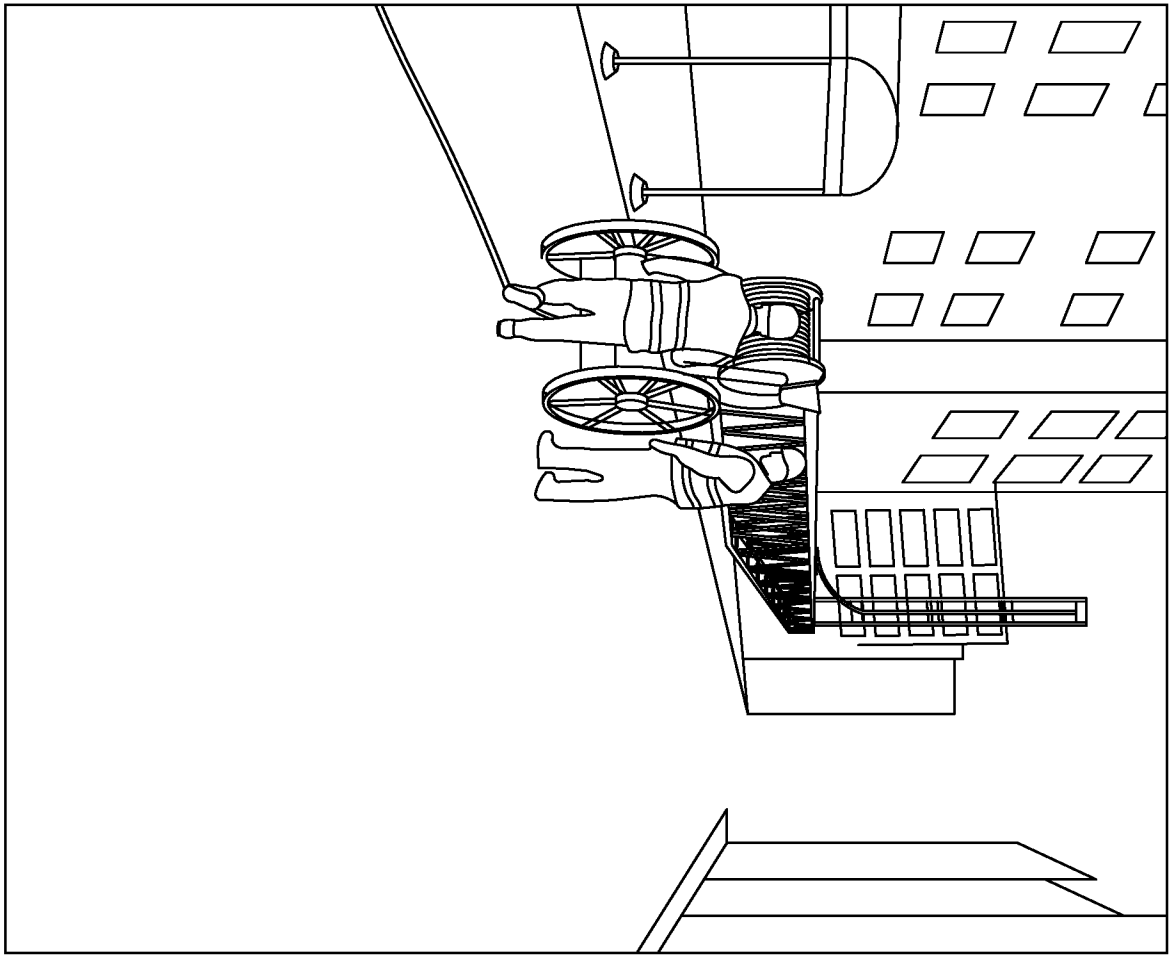
Figure 1G:
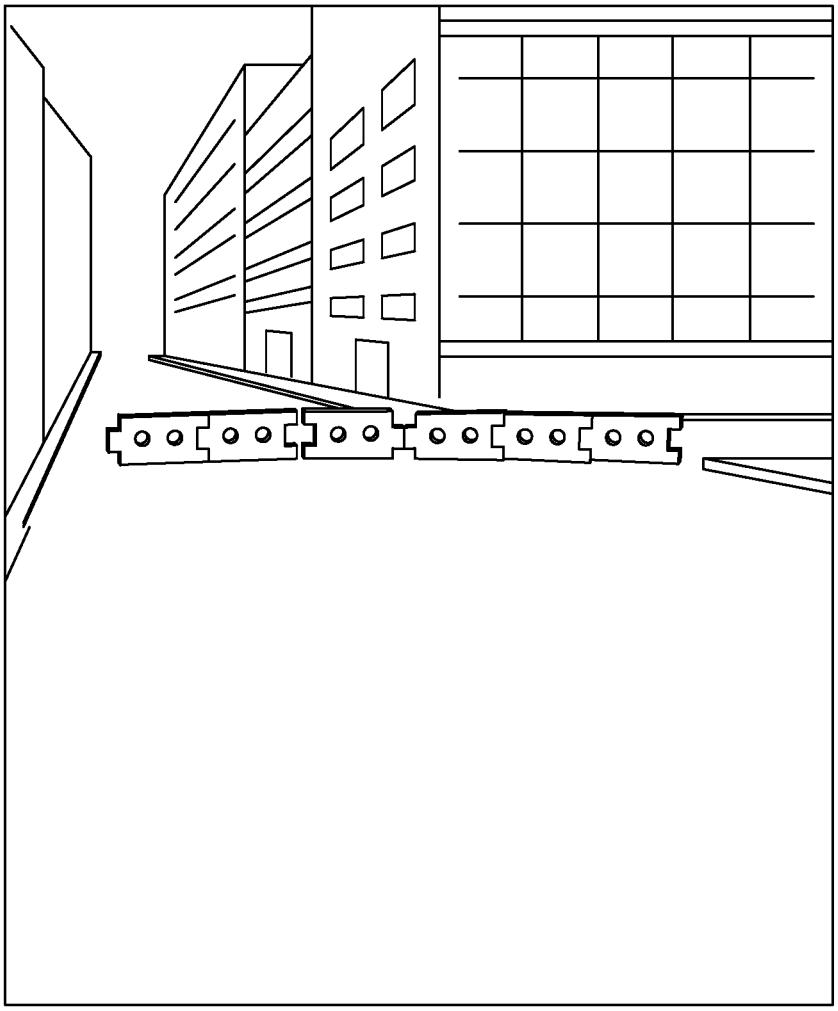
Figure 1H:
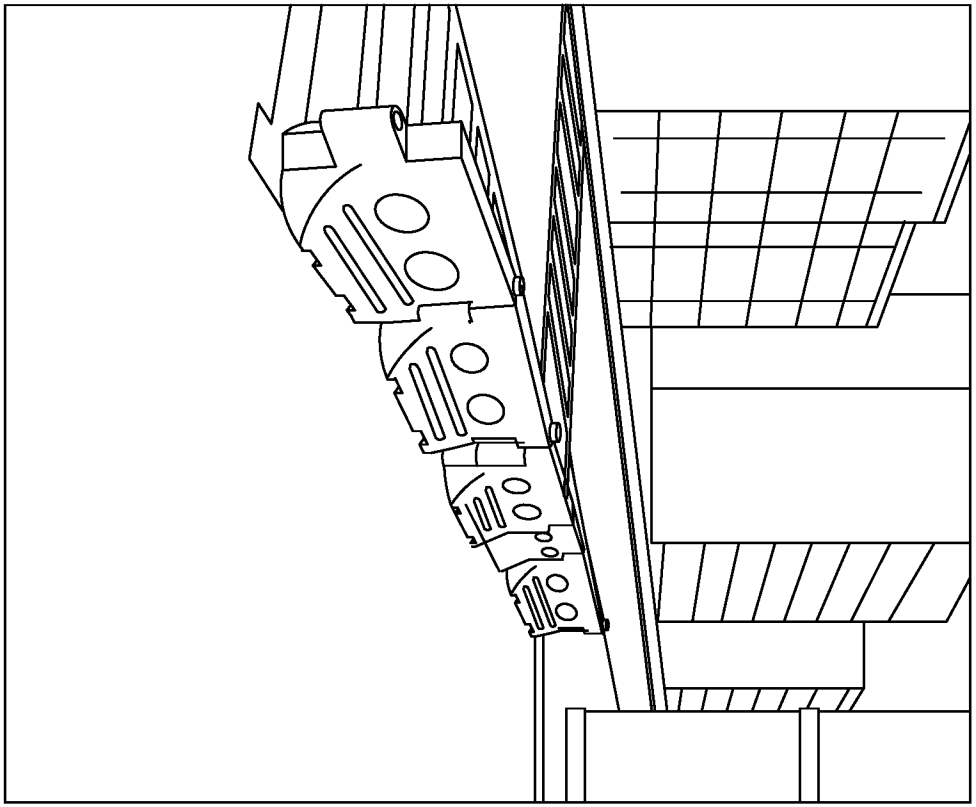
Figure 2:
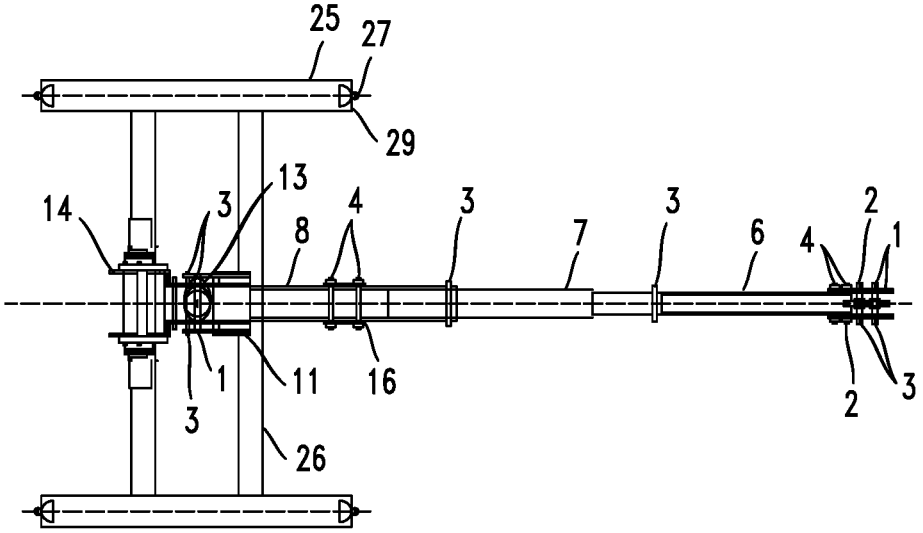
FIG. 2 is a plan view of an assembled embodiment of the portable derrick system according to the present invention, as shown in FIG. 1.

System 12 according to the present invention is illustrated in, for example, FIGS. 1 and 2, as comprising a mast 9 extending vertically upwardly from a mast base 19 at its lower end to masthead sheave assembly 11 at its upper end. A multiple-sectioned boom comprising smaller boom section 6, larger boom section 7 and largest section 8 extends from masthead sheave assembly 11 at one end (left, as shown in FIG. 1) to boomhead assembly 2 at its other (right) end. A piston/cylinder assembly 10 supports the boom at its upper end at piston/boom connecting assembly 16, while its lower end is supported at piston/base connecting assembly 17.

Figure 3:
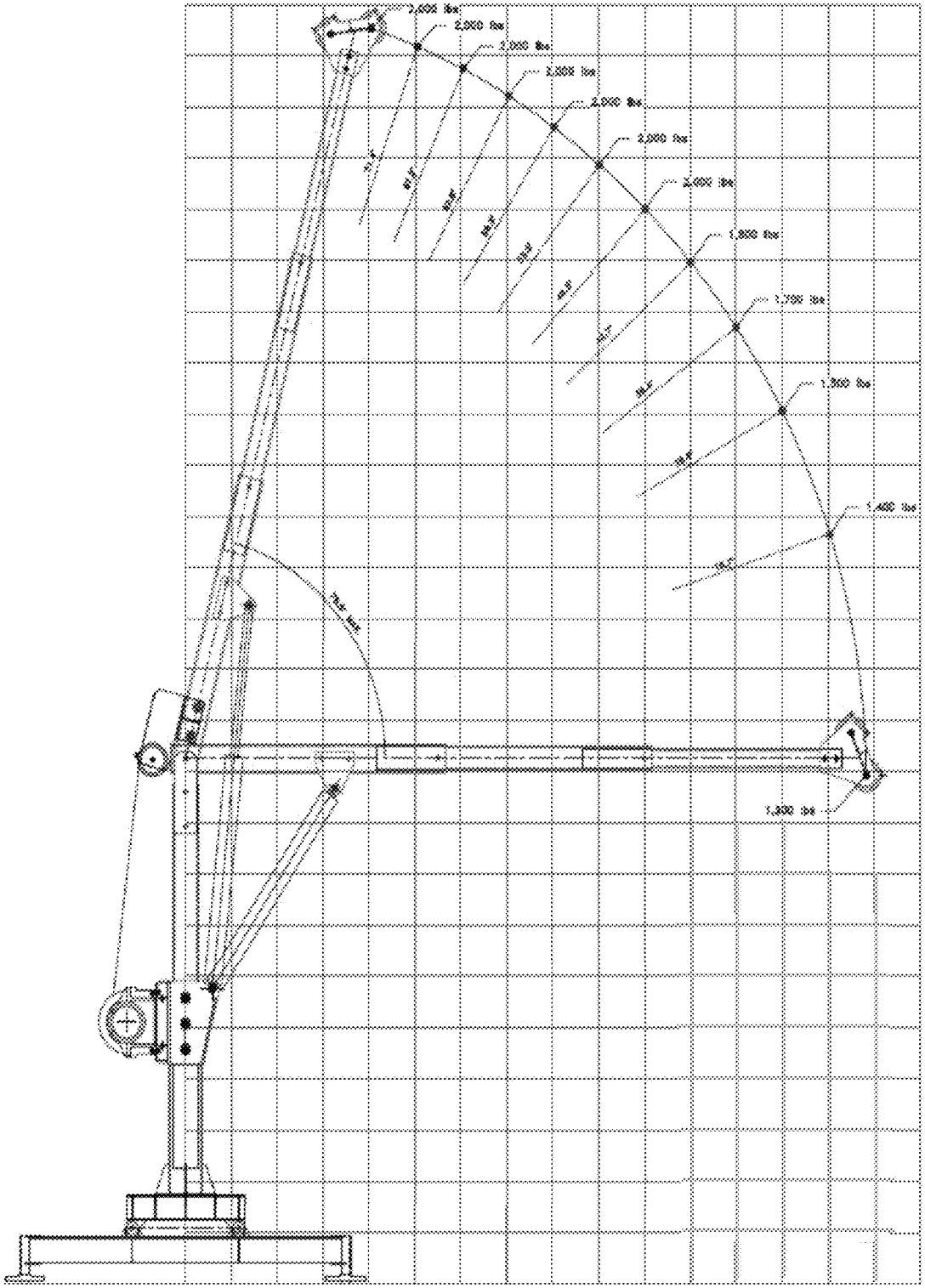
FIG. 3 is a partial combined range diagram and load chart, with values included, the horizontal axis representing the operating radius from the centerline of rotation of an embodiment of the portable derrick system according to the present invention, and the vertical axis representing the height above base elevation, such as street level.
Figure 4:
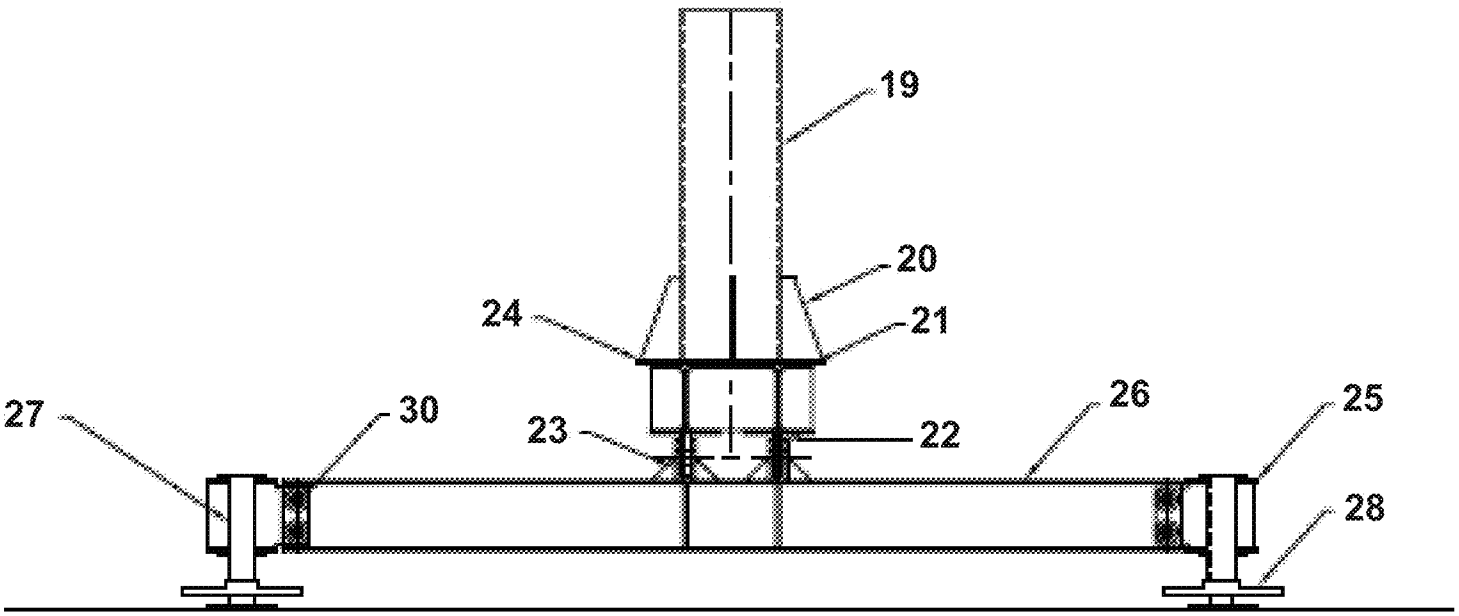
FIG. 4 is an elevation view taken along plane 4-4 of FIG. 1.
Figure 5:
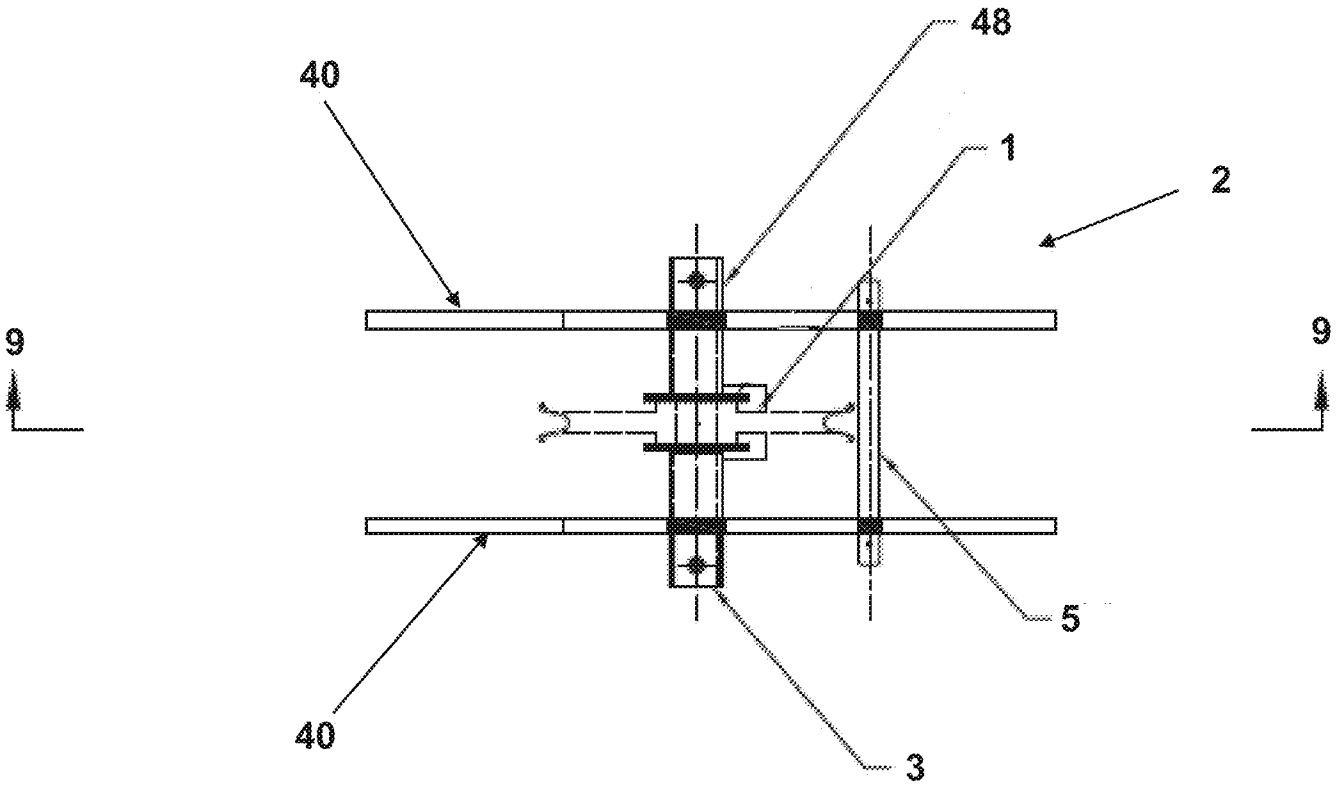
FIG. 5 is a sectional view of a portion of an embodiment of the portable derrick system according to the present invention.

FIG. 3 illustrates a combined range diagram and load chart, with values included, the horizontal axis representing the operating radius from the centerline of rotation of an embodiment of the portable derrick system according to the present invention, and the vertical axis representing the height above base elevation, such as street level.

Figure 11:
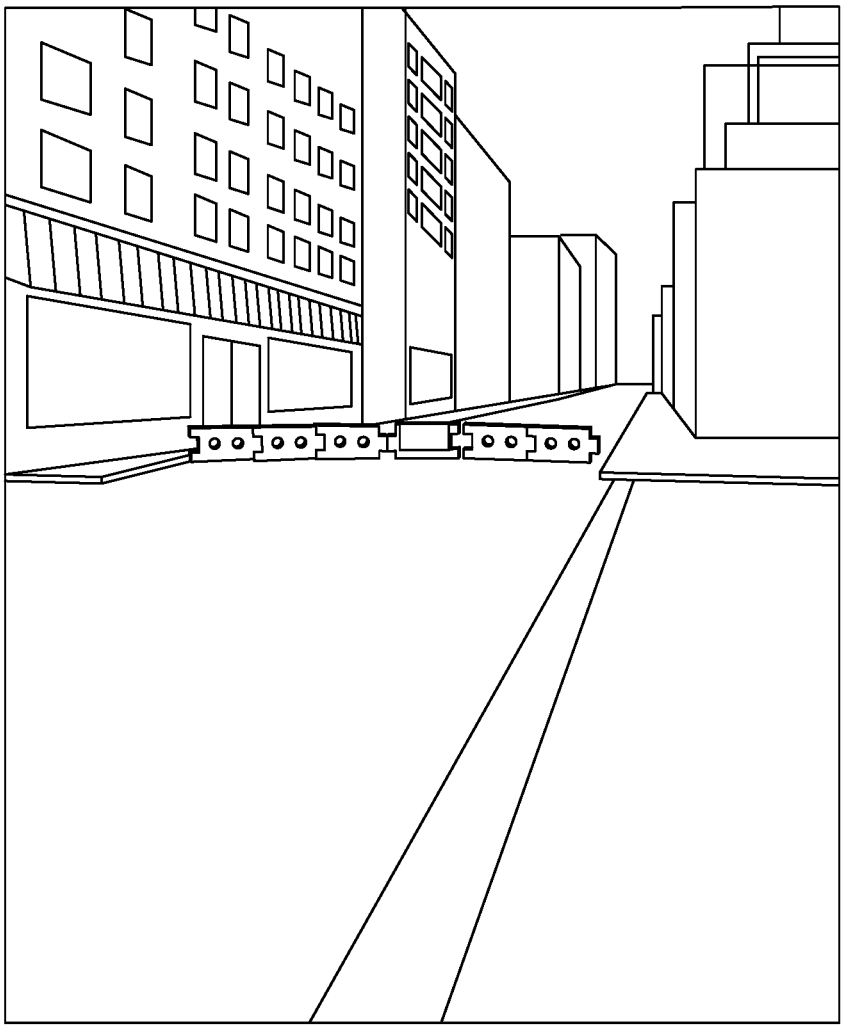
FIG. 11 is a plan view of the hoist mount, in which a hoist base bracket, hoist mount pin and a partial cylinder bottom connection assembly are shown.
Figure 12:
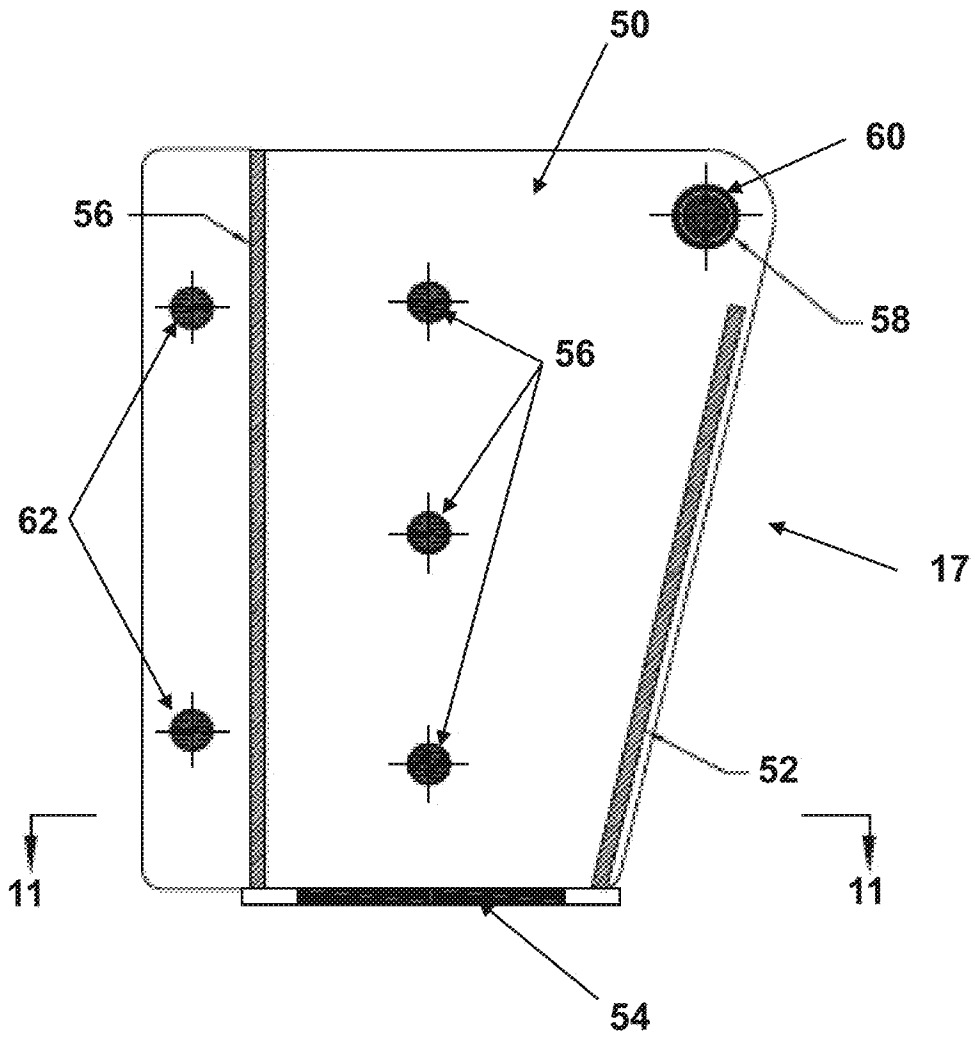
FIG. 12 is a sectional view taken along plane B-B of FIG. 5.
Figure 13:
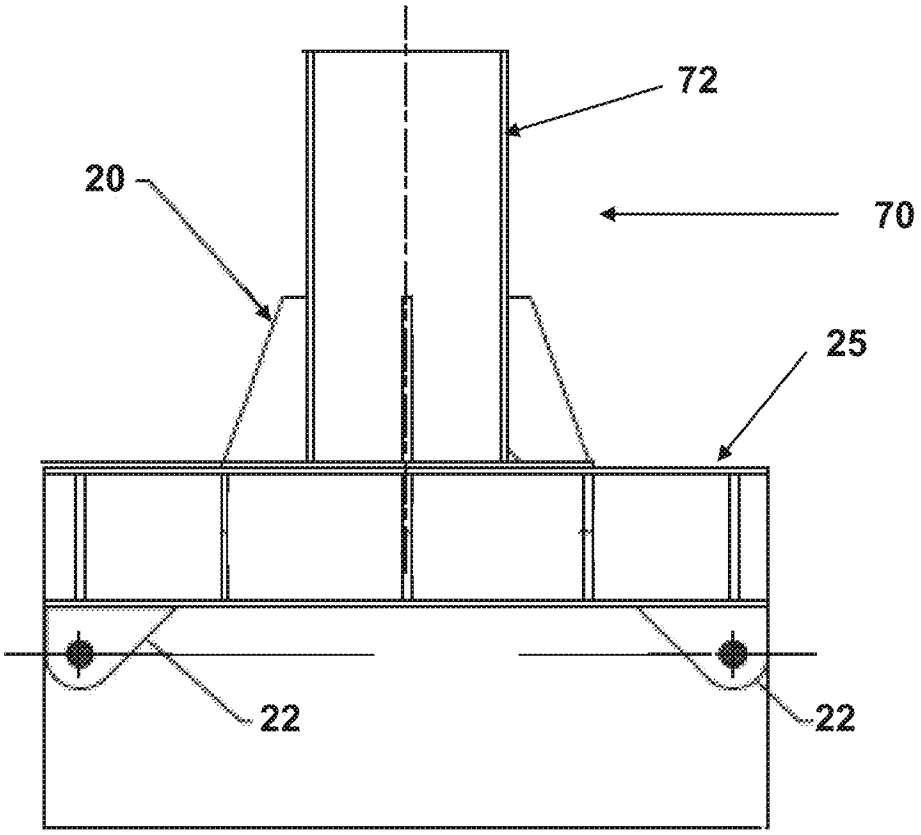
FIG. 13 is a partial side elevation view of a post base assembly of an embodiment of the portable derrick system according to the present invention.

A winch assembly 14 and its components are shown in FIGS. 1, 11 and 12 supported at the elevation of the piston/base connecting assembly 17, and it cooperatively operates with its associated winch cable 32 which, in turn, extends around roller bearing sheaves 1 mounted on the masthead sheave assembly 11 and boomhead assembly 2. Winch cable 32 extends from its windings about the spool of winch assembly 14 at one end to, at its other end, headache ball 34 and positive-locking load-carrying hook 36. Hook 36 is used to support a load, such as the air conditioner, best seen being hoisted in FIG. 30. Hook 36 is designed to close upon itself under load, as a safety mechanism.

I pause here to emphasize that the various components of system 12 according to the present invention are capable of being repeatedly disassembled and reassembled at job sites and other locations. This is accomplished without sacrificing strength and reliability of the system. With the present invention, it is possible and desirable to have the components comprising system 12 disassembled such that they can be handled and carried by human personnel up and down one or more flights of stairs or ramps, where necessary. For example, if the system 12 is to be used on a roof to which a load is raised, the components of system 12 can be carried up a building elevator to an upper landing which may be, for example, one flight of stairs below the roof. These components can then be carried up the flight of stairs from this landing to the roof level, where they are assembled for use according to the present invention. When the hoisting job has been completed, these same components are disassembled, carried down the single flight of stairs to the elevator, and thereafter carried by elevator to the street or basement level where they can be carried to a truck used to carry system 12 to the job site. In describing the components of system 12 with respect to the annexed drawings, it will become clear how these components are removably interconnected by means of threaded rods, bolts and fastening means. Ordinary tools are used to assemble and disassemble the components of system 12.

Boom sections 6, 7 and 8 are slideably connected to one another (FIG. 1) and held by means of connecting pins 3. By having interlocking boom sections, the user of system 12 is able to assemble booms of different lengths, as the job, building configurations and loads require. Threaded rods 4 hold boom section 6 to boomhead assembly 2. Rods 4 extend through openings 38 through plates 40 of boomhead assembly 2, as well as through boom section 6. The plates 40 of boomhead assembly 2 are further formed with ears 42 through which openings 44 accommodate pins 5, which serve to prevent winch cable 32 from escaping from roller bearing sheaves 1. Plates 46 reinforce the structural integrity of boomhead assembly 2. Pipe spacers 48 rotatably support roller bearing sheaves 1 of boomhead assembly 2, as also seen in FIGS. 5, 8, 9 and 10.

Piston/base connecting assembly 17 serves, among other purposes, to support the bottom (as shown in FIG. 1 of piston/cylinder 10. Assembly 17 includes a pair of substantially vertically extending side plates 50 which are joined by connecting plate 52, as well as ring plate 54 and plate 56, to form relatively box-like structure best seen in FIG. 11. Side plates 50 include openings 56 through which threaded rods 4 extend to connect plates 50 to mast 9. A pipe spacer 58 interconnects plates 50 with piston/cylinder assembly 10, by extending through holes 60 therethrough, shown in FIG. 12. Holes 62 accommodate a hoist mount pin 64, while holes in angle plates 66 accommodate pin 64. Holes 68 provide means for mounting winch assembly 14 to the piston/base connecting assembly, such that it is positioned as shown in FIG. 1.

Figure 14:
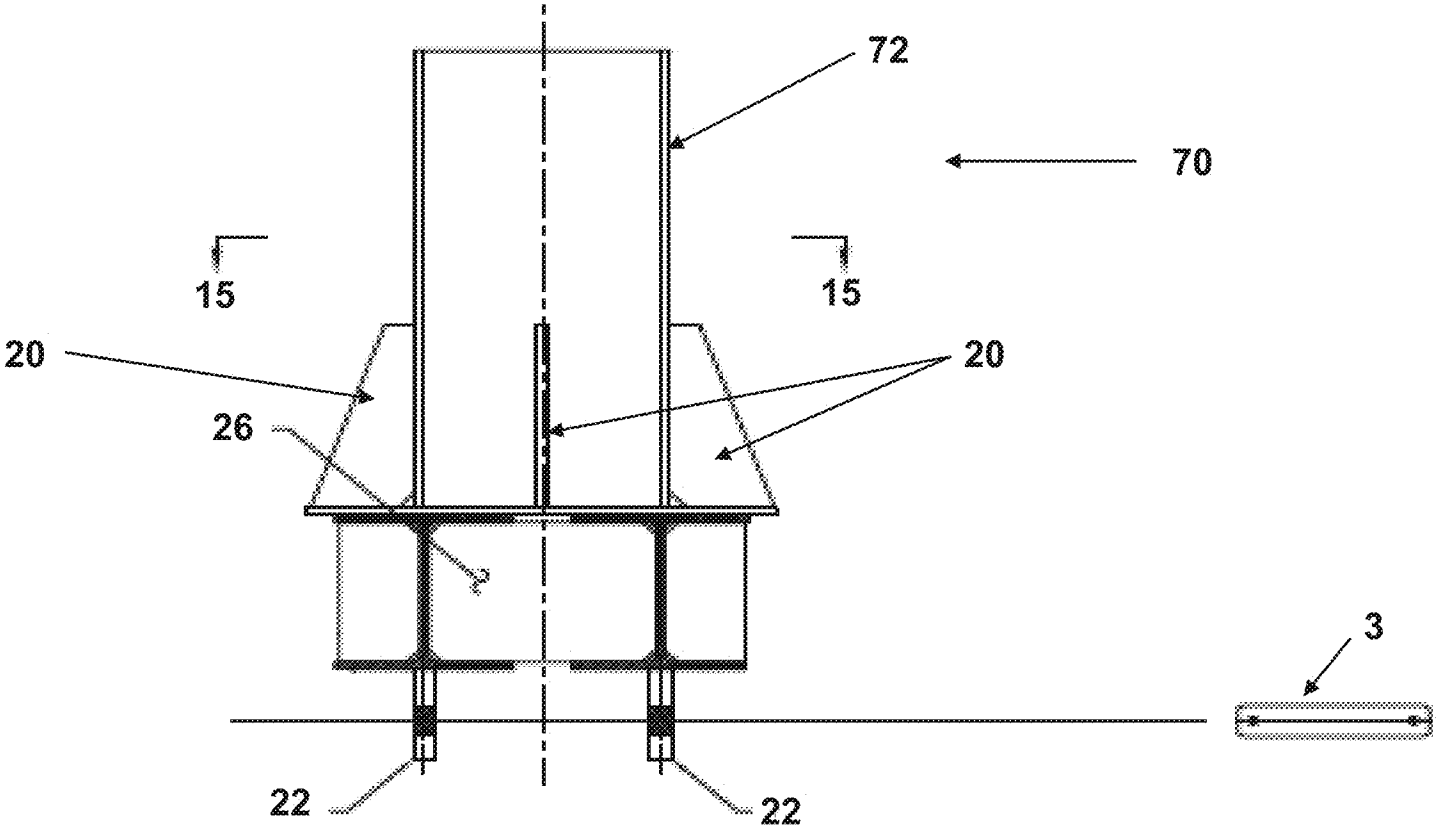
FIG. 14 is an end view of the post base assembly of FIG. 13.
Figure 15:
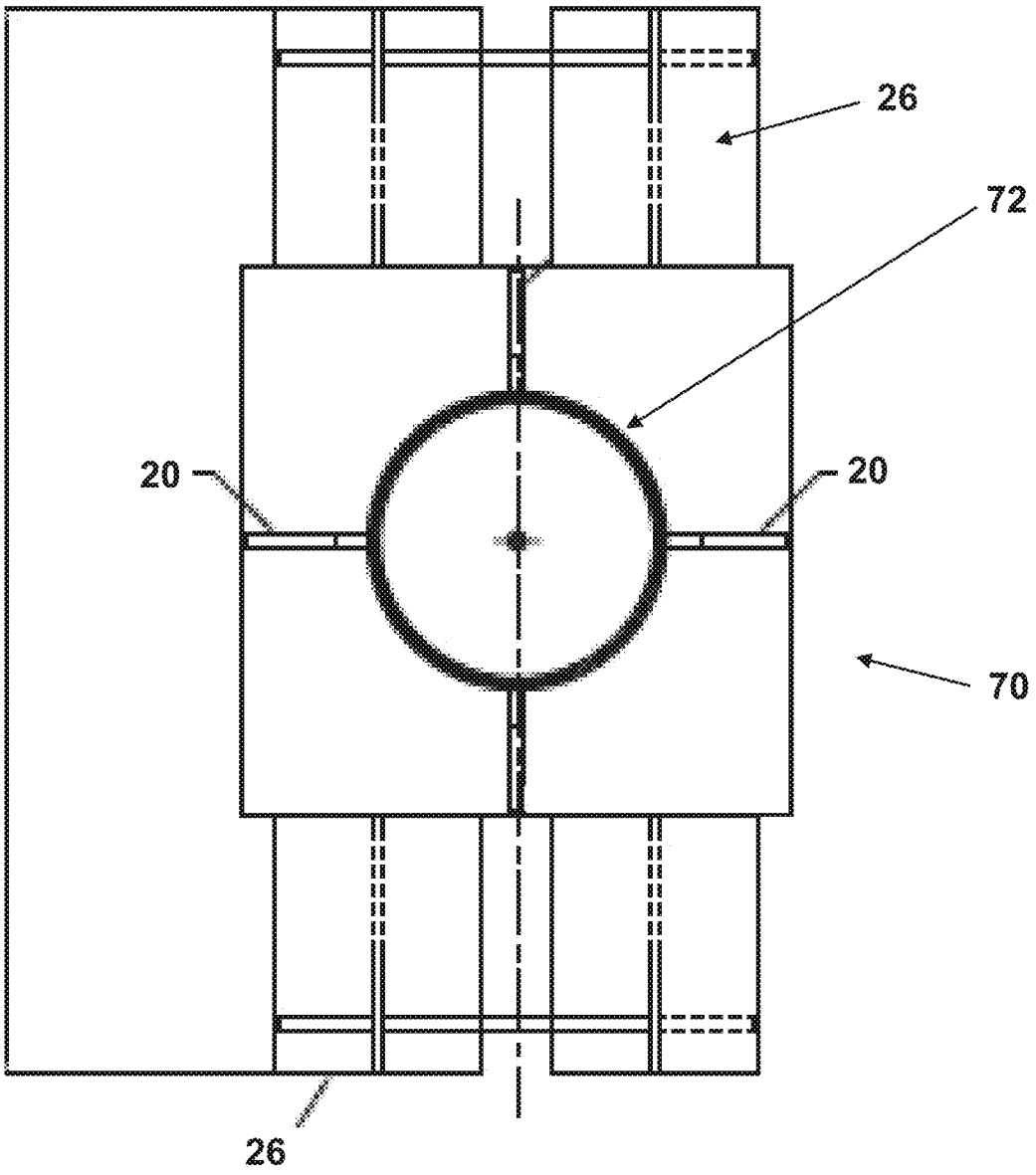
FIG. 15 is a sectional plan view taken along plane 15-15 of FIG. 14.

FIGS. 4, 13, 14, 15, 19, 20 and 21 illustrates a portion of mast post base assembly 70, including mast post 72 secured by base gussets 20 to strut beam 26 which extends between outrigger beams 25 (see FIG. 14). Top connection ears 22 with an opening in each extend downwardly and are linked to bottom connection ears 23 with an opening in each by means of a pin 3.

Figure 16:
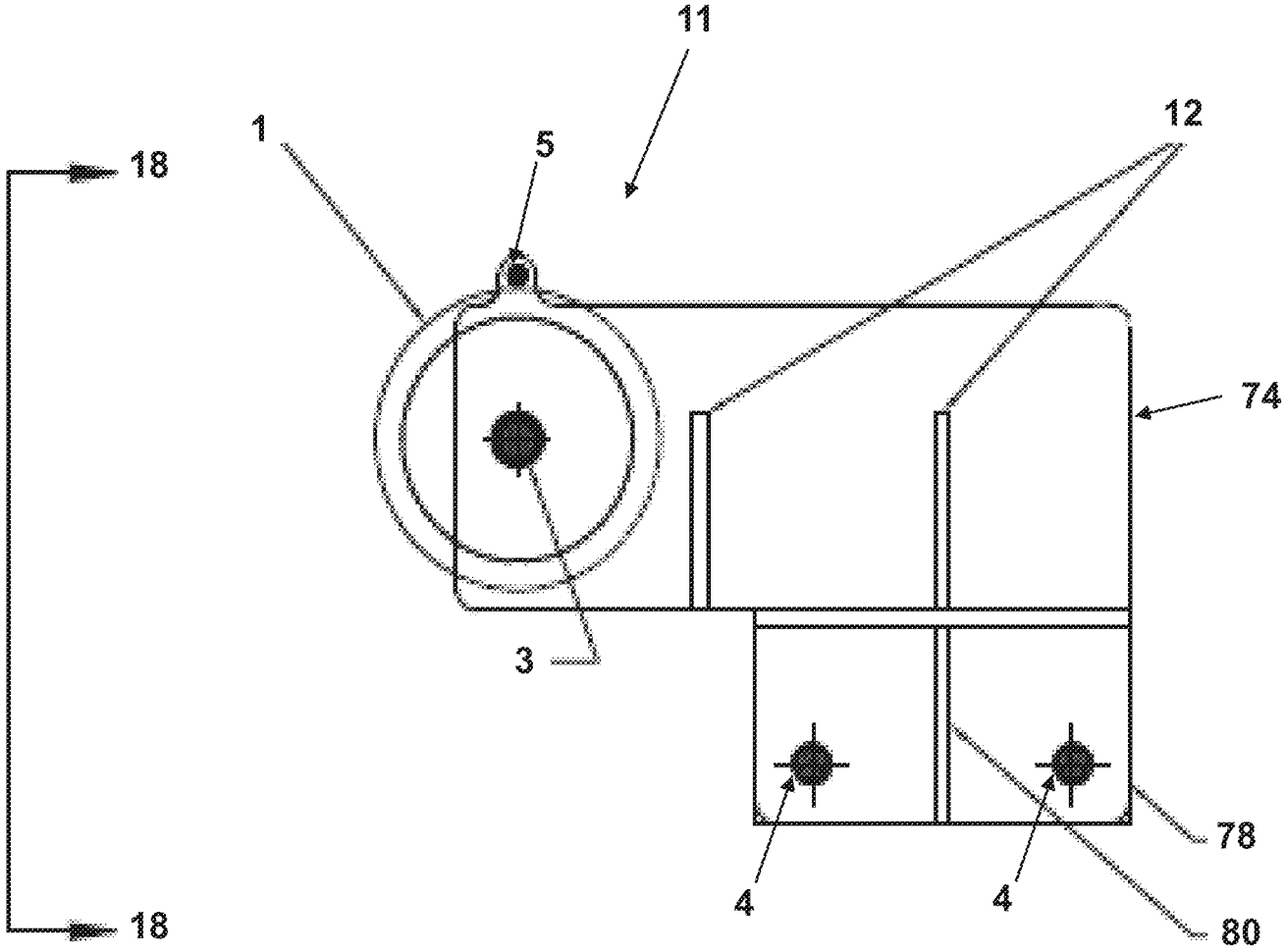
FIG. 16 is a side elevation view of the mast top fleet sheave assembly of the embodiment of the portable derrick system according to the present invention shown in FIG. 1.
Figure 17:
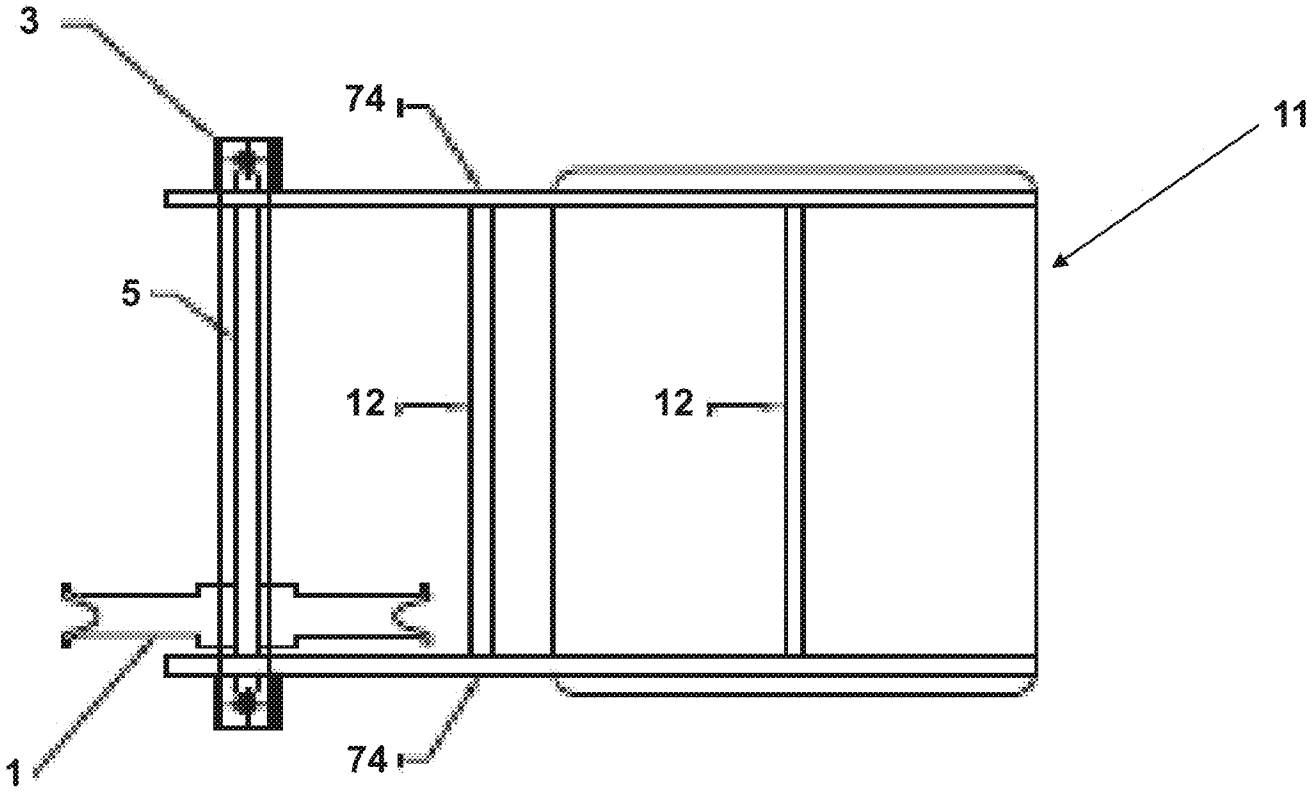
FIG. 17 is a plan view of the mast top fleet sheave assembly of FIG. 16.
Figure 18:
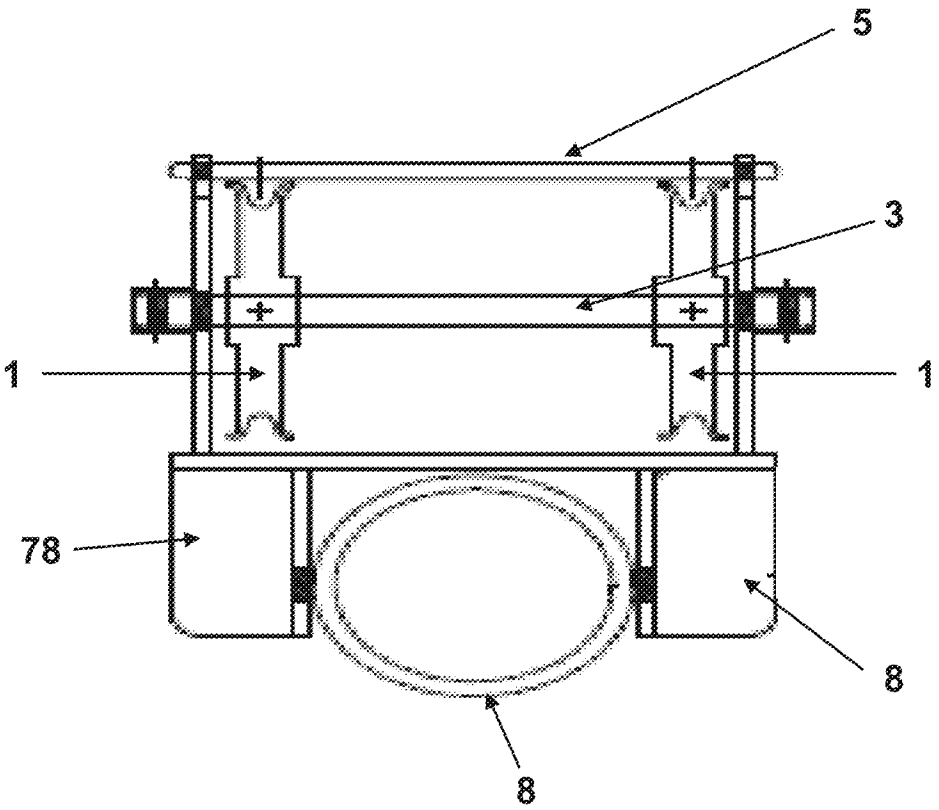
FIG. 18 is an end view taken along plane 18-18 of FIG. 16.
Figure 19:
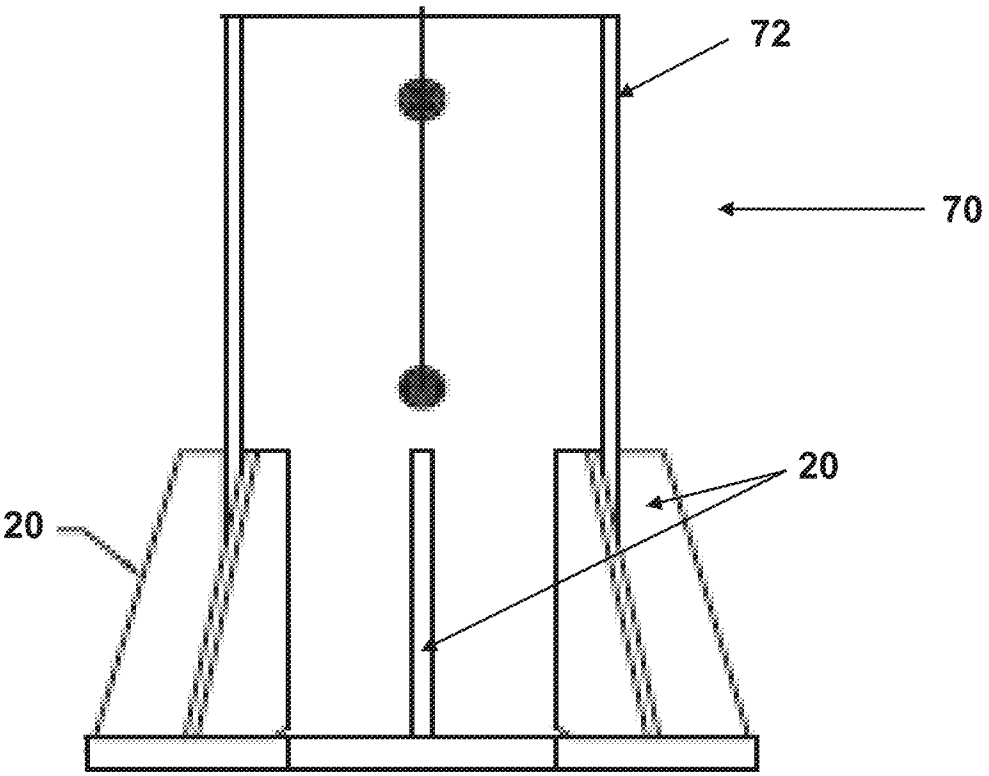
FIG. 19 is an elevation view of the mast base of an embodiment of the portable derrick system according to the present invention shown in FIG. 1.
Figure 20:
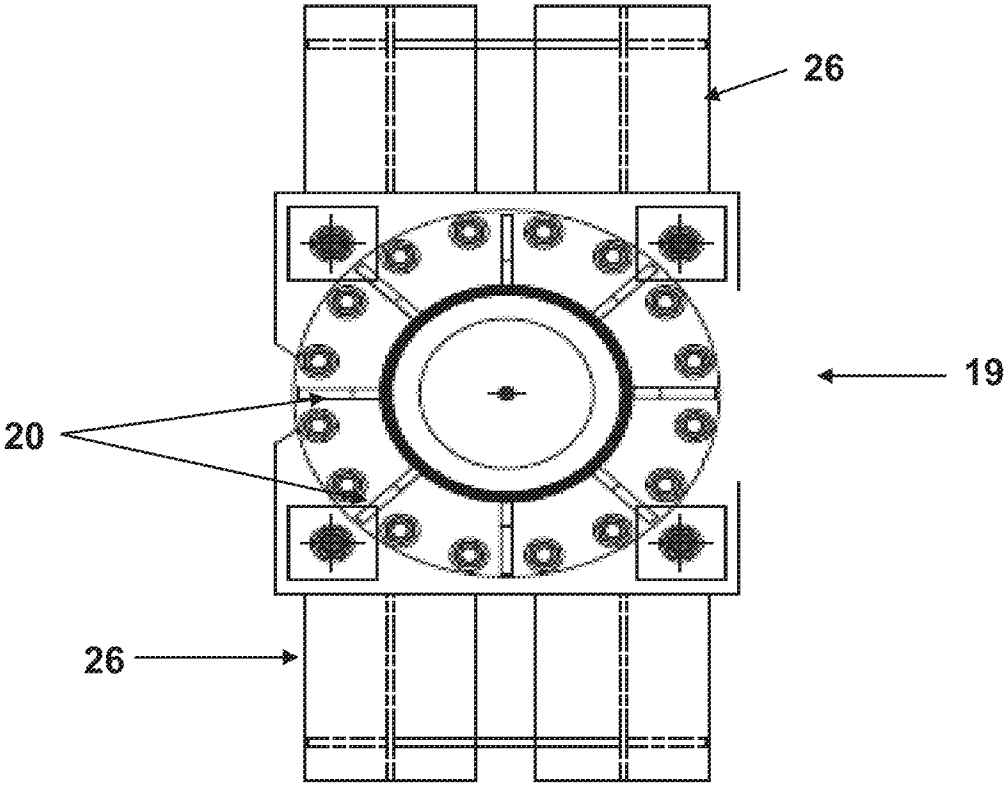
FIG. 20 is a view of a revised post base assembly of an embodiment of the portable derrick system according to the present invention.

Mast 9 extends upwardly to a masthead fleet sheave assembly 11. Assembly 11, shown in FIGS. 16-18, is formed with lateral plates 74 which are reinforced by stiffener plates 12. A roller bearing sheave 1 is held between plates 74 by means of a pipe keeper pin 3. An upwardly extending plate ear 76 of each lateral plate 74 includes an opening therethrough, which accommodate a pipe or pin 3 located such that it prevents winch cable 32 from escaping from sheave 1 when in use. Plates 78, stiffened by means of stiffener plate 80, are formed with holes to receive threaded rods 4 which, in turn, hold plates 78 and thus masthead sheave assembly 11 to the boom section 8.

Figure 6:
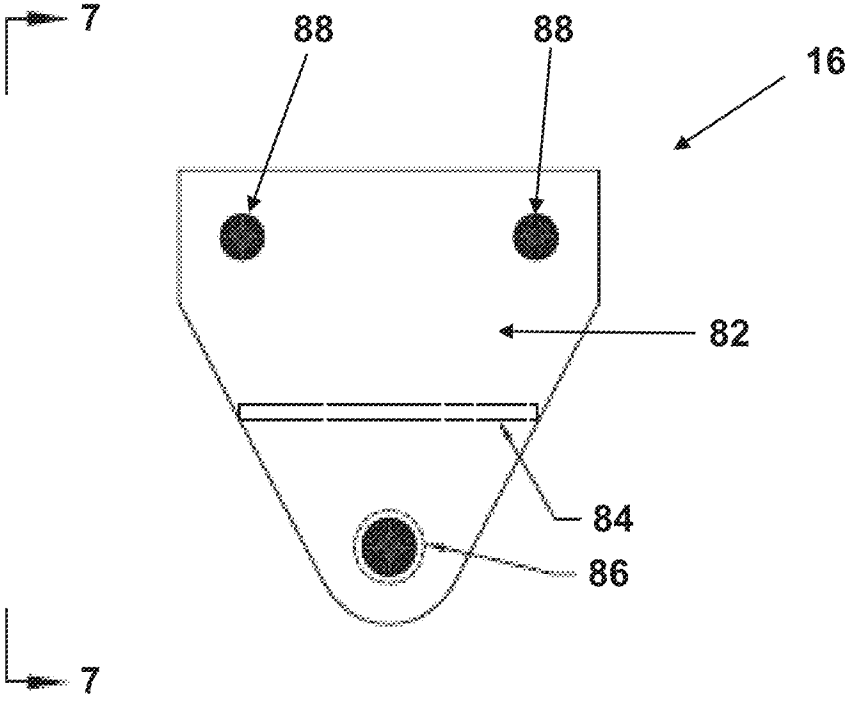
FIG. 6 is an elevation view of the cylinder top assembly, including a pair of plates.
Figure 7:
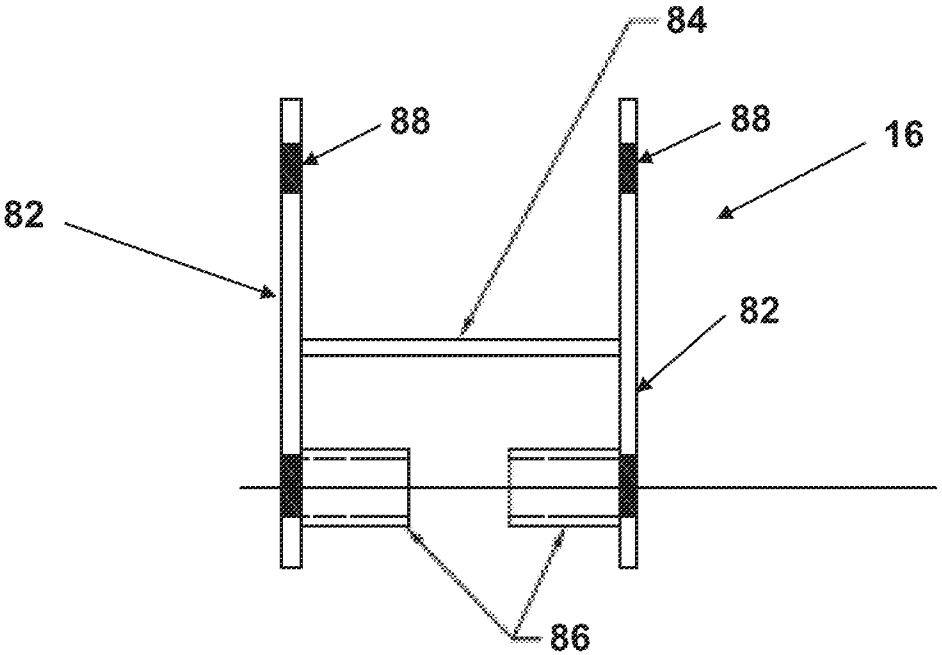
FIG. 7 is a side elevation view of the cylinder top assembly shown in FIG. 6, looking along plane 7-7.
Figure 8:
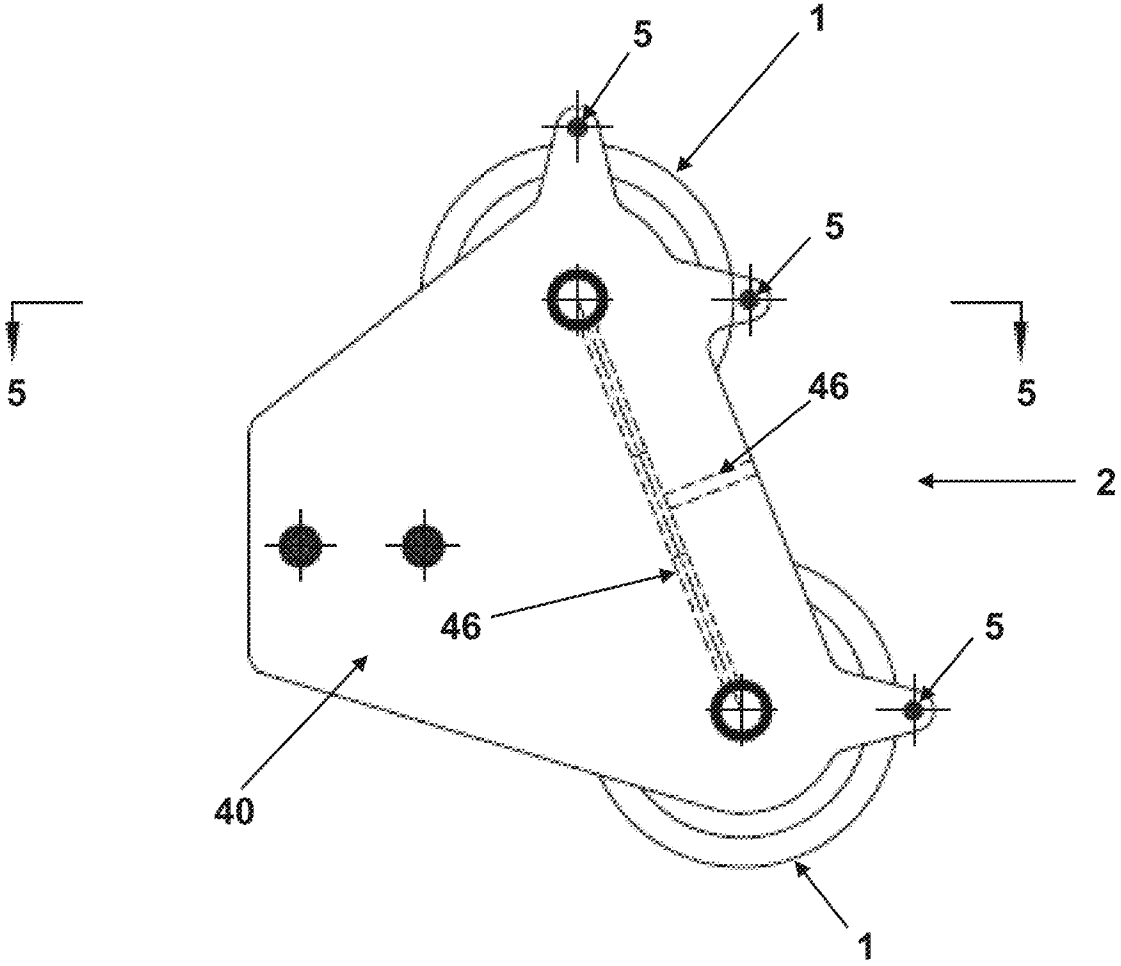
FIG. 8 is an enlarged elevation view of the boom head assembly according to an embodiment of the portable derrick system according to the present invention, as shown in FIG. 1.
Figure 9:
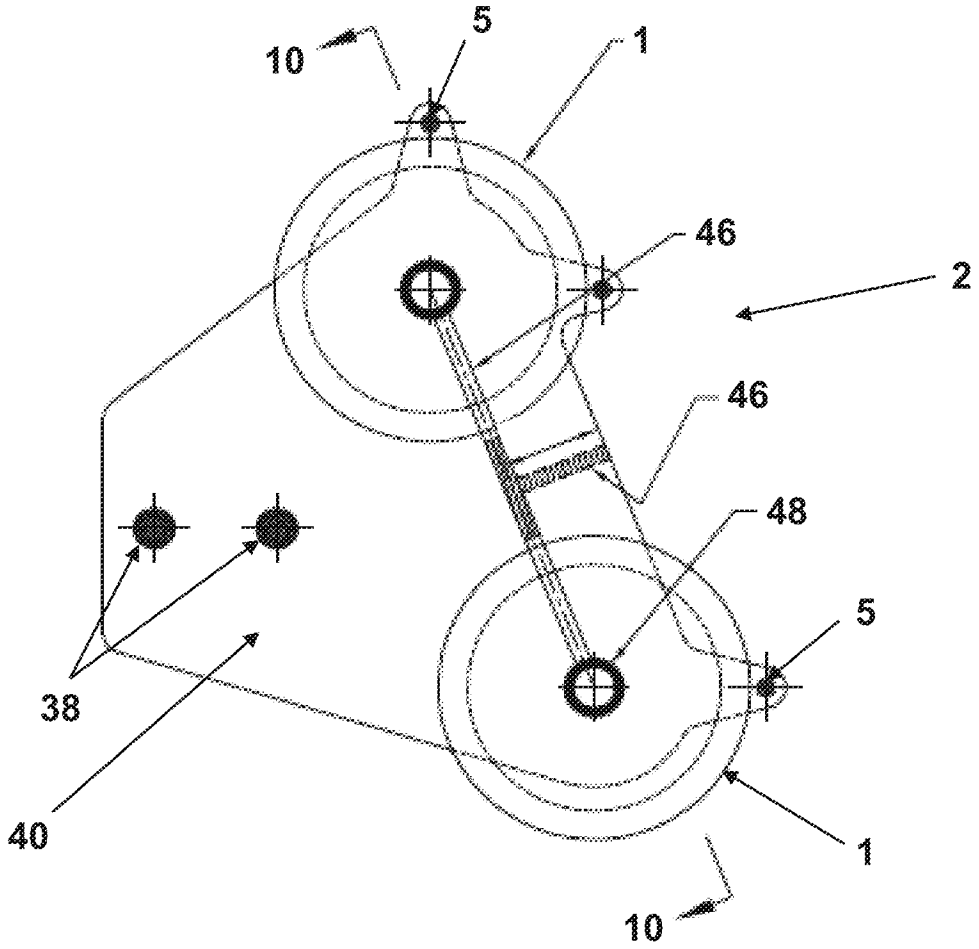
FIG. 9 is another view of the boom head assembly of FIG. 8, providing a cross-sectional type of view along plane 9-9 of FIG. 5.
Figure 10:
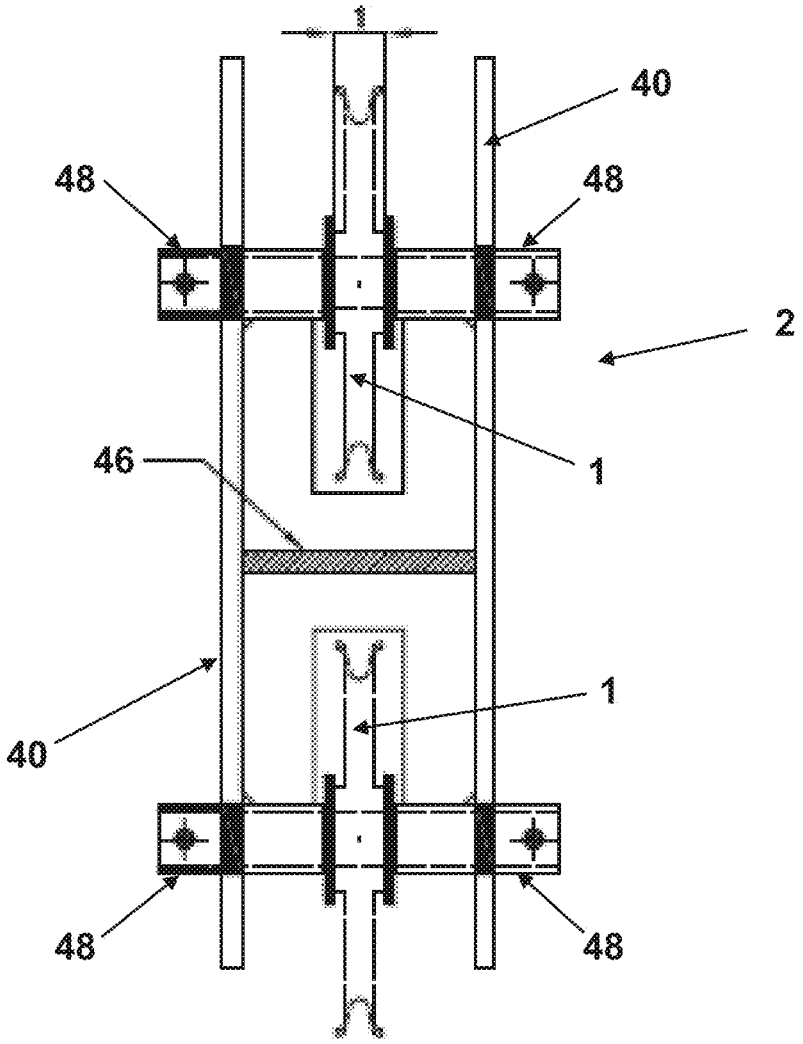
FIG. 10 is a sectional view taken along plane 10-10 of FIG. 9.
Figure 11:
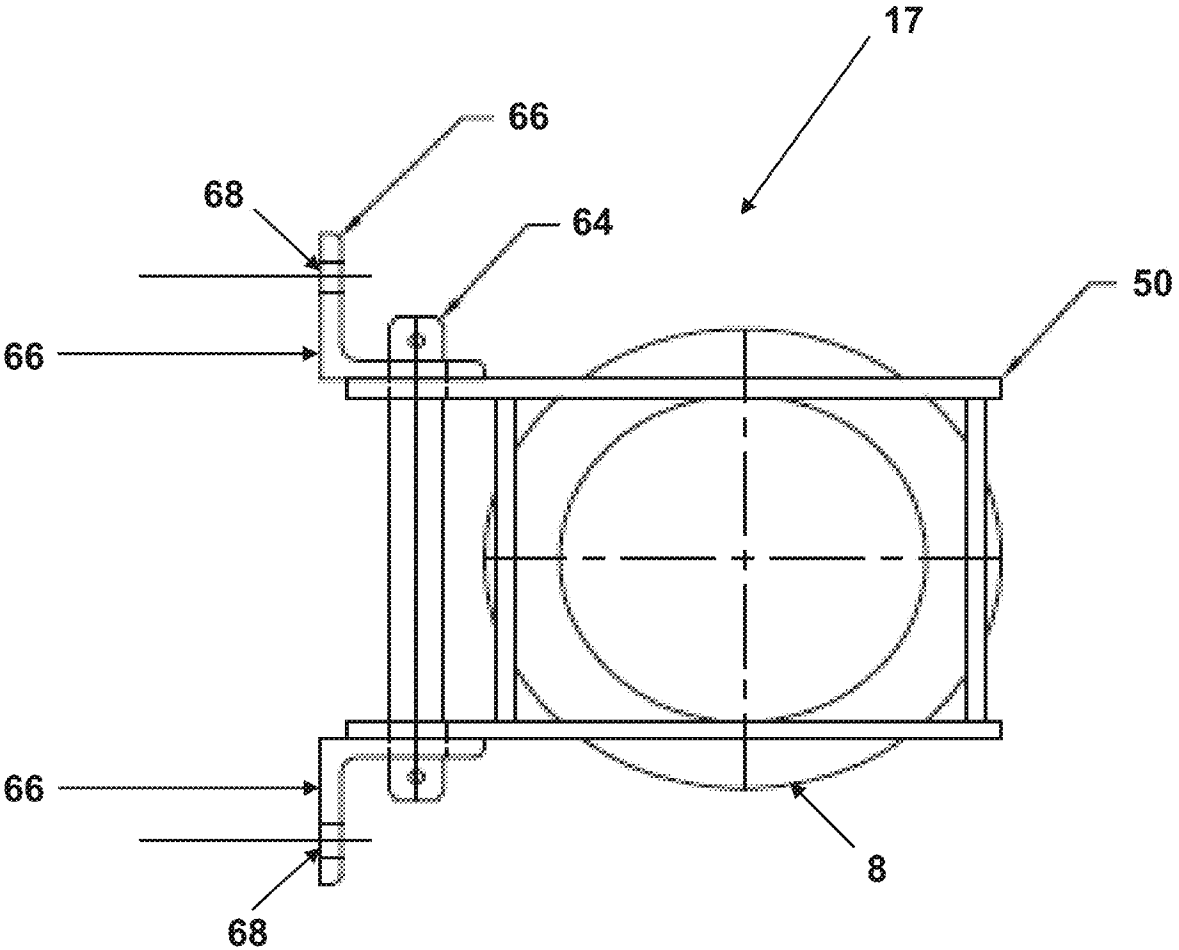

FIGS. 6 and 7 illustrate components of the piston/boom connection assembly 16, formed with lateral plates 82 joined by a stiffener plate 84. Plates 82 are formed with openings adjacent pipe spacers 86 capable of accommodating a pin 15, which holds the upper end of the piston of piston/cylinder assembly 10 to the boom. In this way, hydraulic fluid controls enable the operator of the present invention to increase pressure to extend the piston within its cylinder, thereby controlling the disposition of the boom and its joined sections 6, 7 and 8. Openings 88 in plates 82 receive threaded rods that secure plates 82 to the boom section 8 (see FIG. 1).

Figure 25:
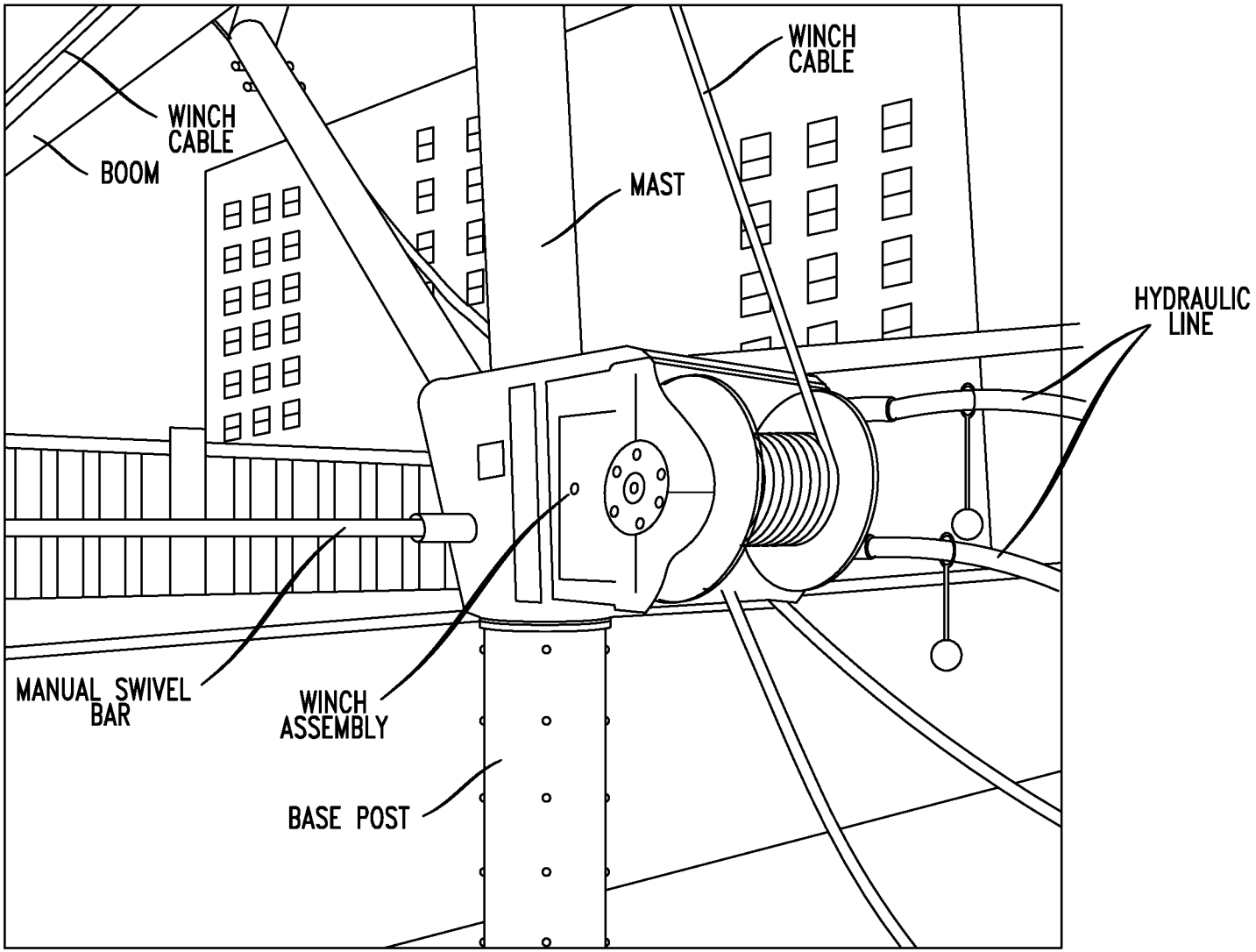
FIG. 25 is a closer photograph at the site of FIG. 30, wherein the winch and its cable are enlarged, and wherein a horizontal turning bar used for manual turning (now replaced by a pinion-driven gear and bearing assembly) is shown.
Figure 26:
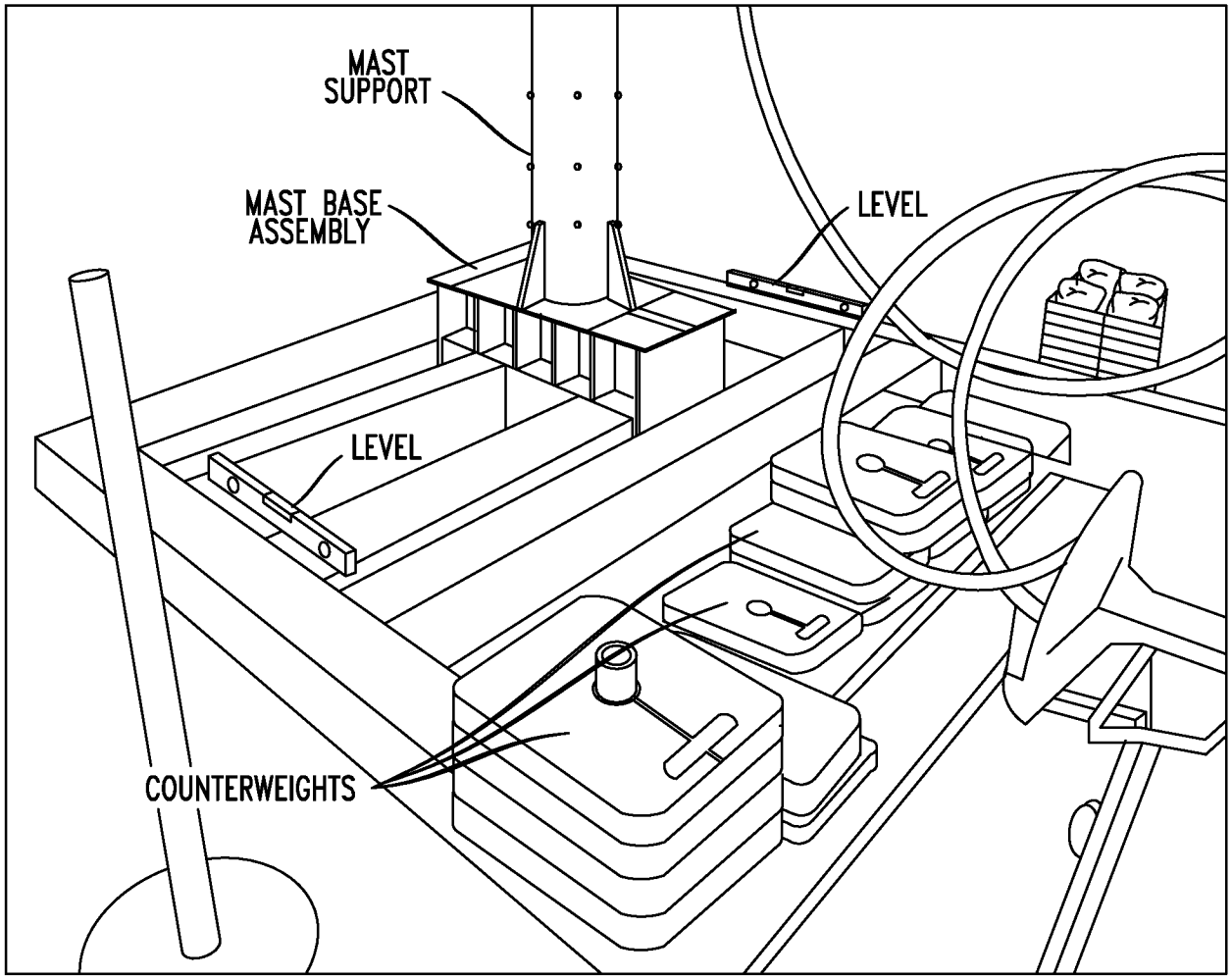
FIG. 26 is a photograph of the base of an embodiment of the portable derrick system according to the present invention, wherein counterweights are shown to offset the load being hoisted, and in which two spaced carpenter-type levels are situated at the base, to assure a level condition that will prevent undesirable torque forces acting upon the base from, which could overstress base element welds.
Figure 27:
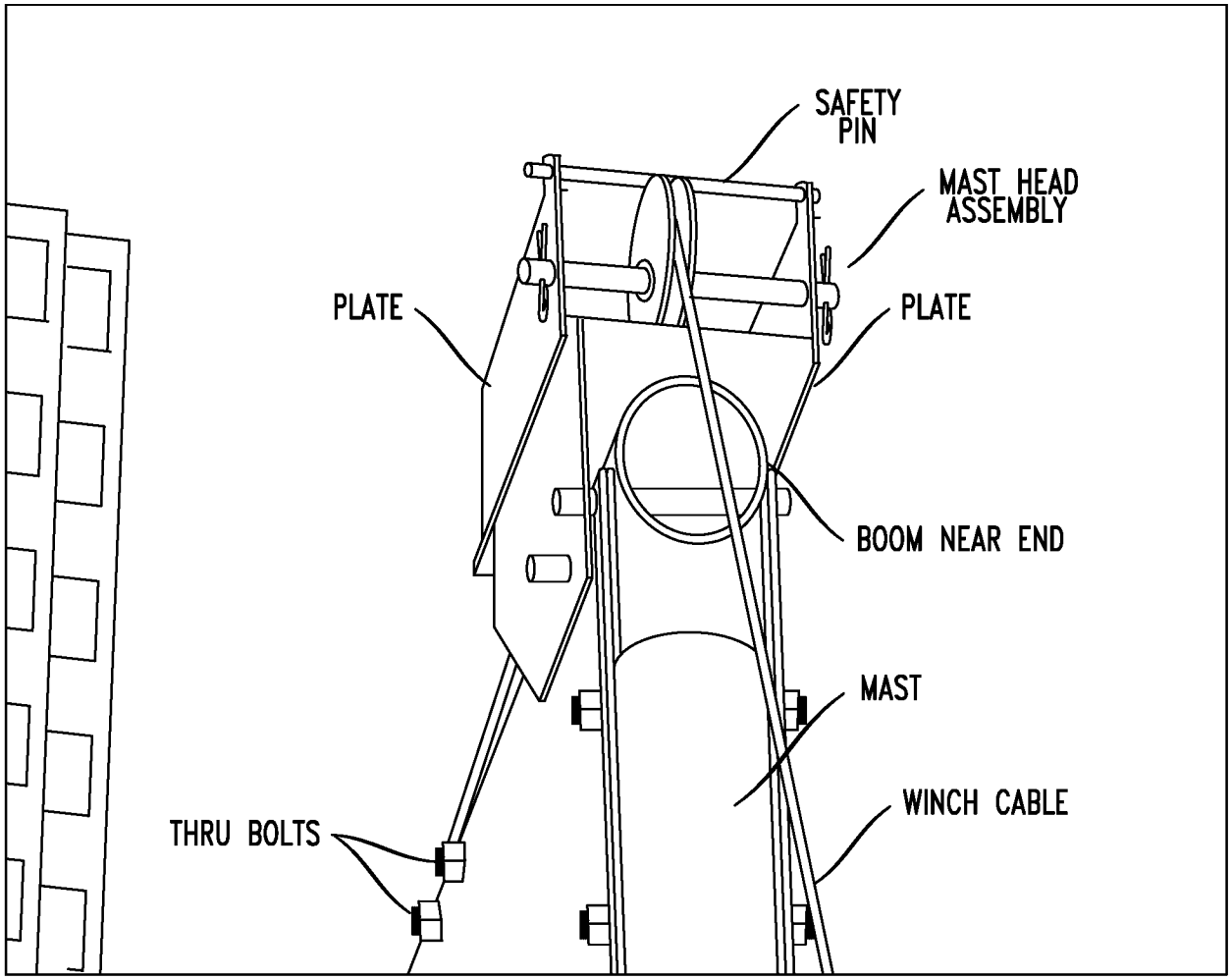
FIG. 27 is a photograph from the rear of the embodiment of the portable derrick system according to the present invention, wherein the near end of the boom and the top of the mast are shown, and further showing the winch cable extending over the masthead sheave.
Figure 28:
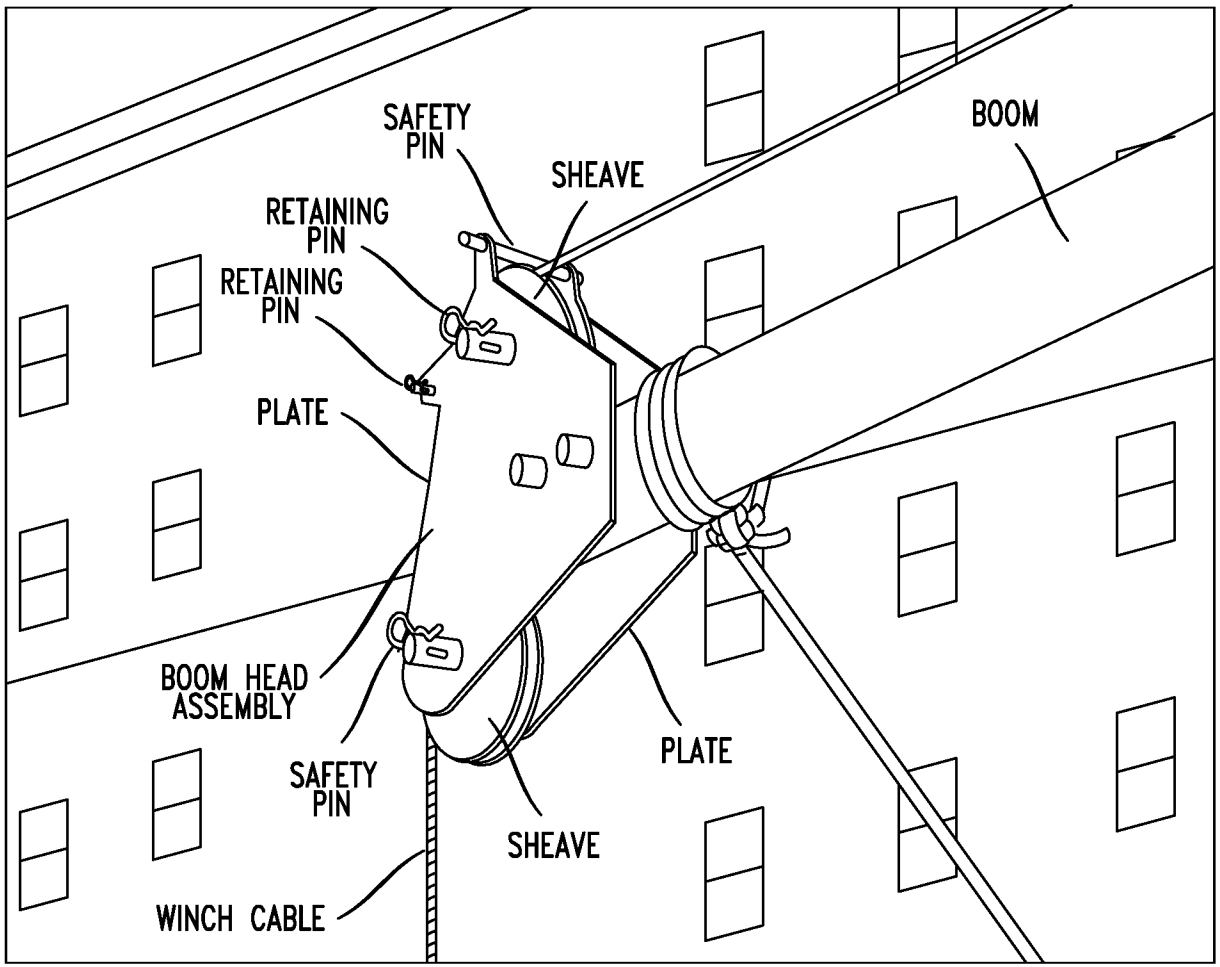
FIG. 28 is a photograph of the boomhead assembly of an embodiment of the portable derrick system according to the present invention, wherein sheaves and safety pins are illustrated, as is the boom and winch cable.
Figure 29:
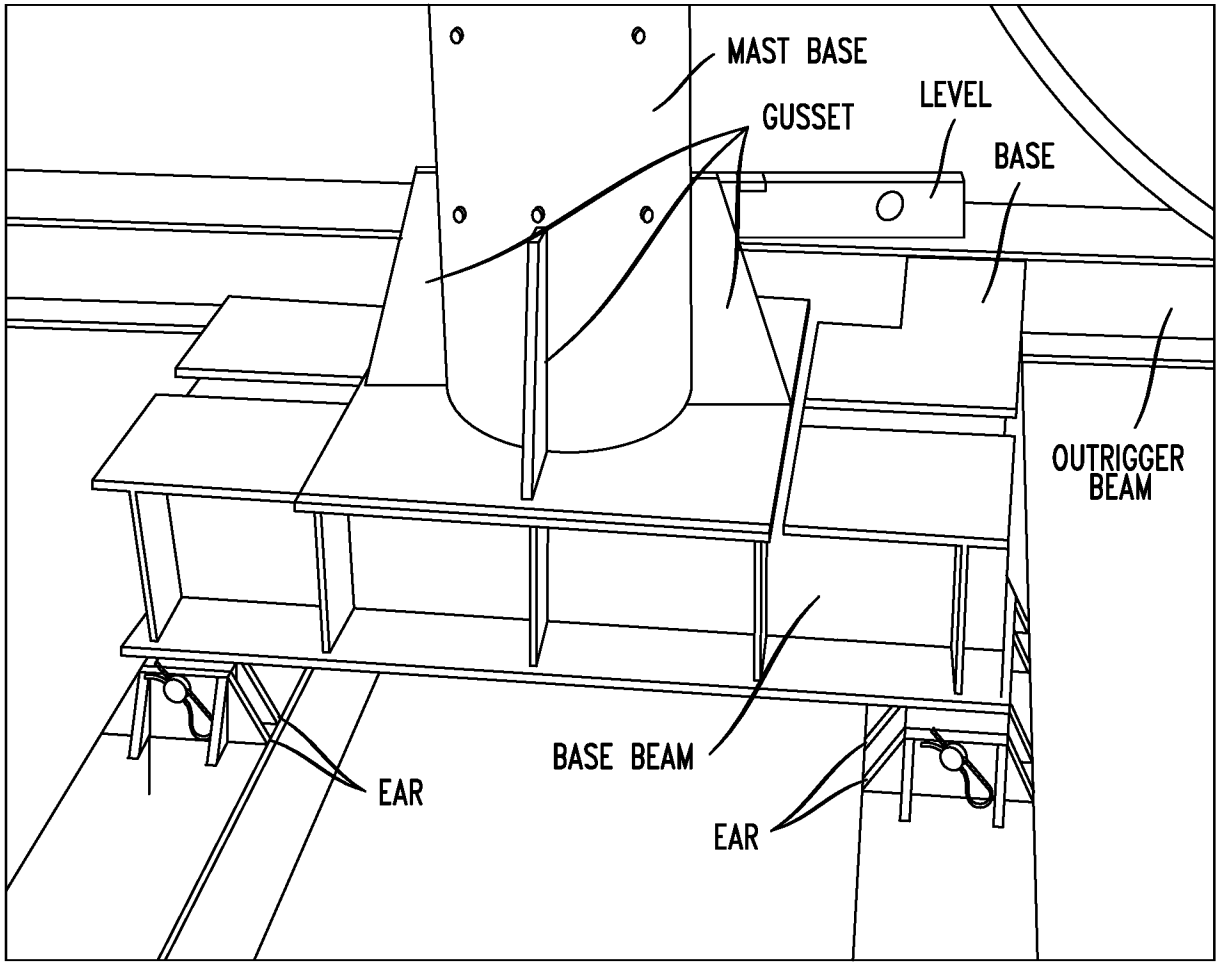
FIG. 29 is a photograph of the base assembly which supports the mast of the embodiment of the portable derrick system according to the present invention.
Figure 30:
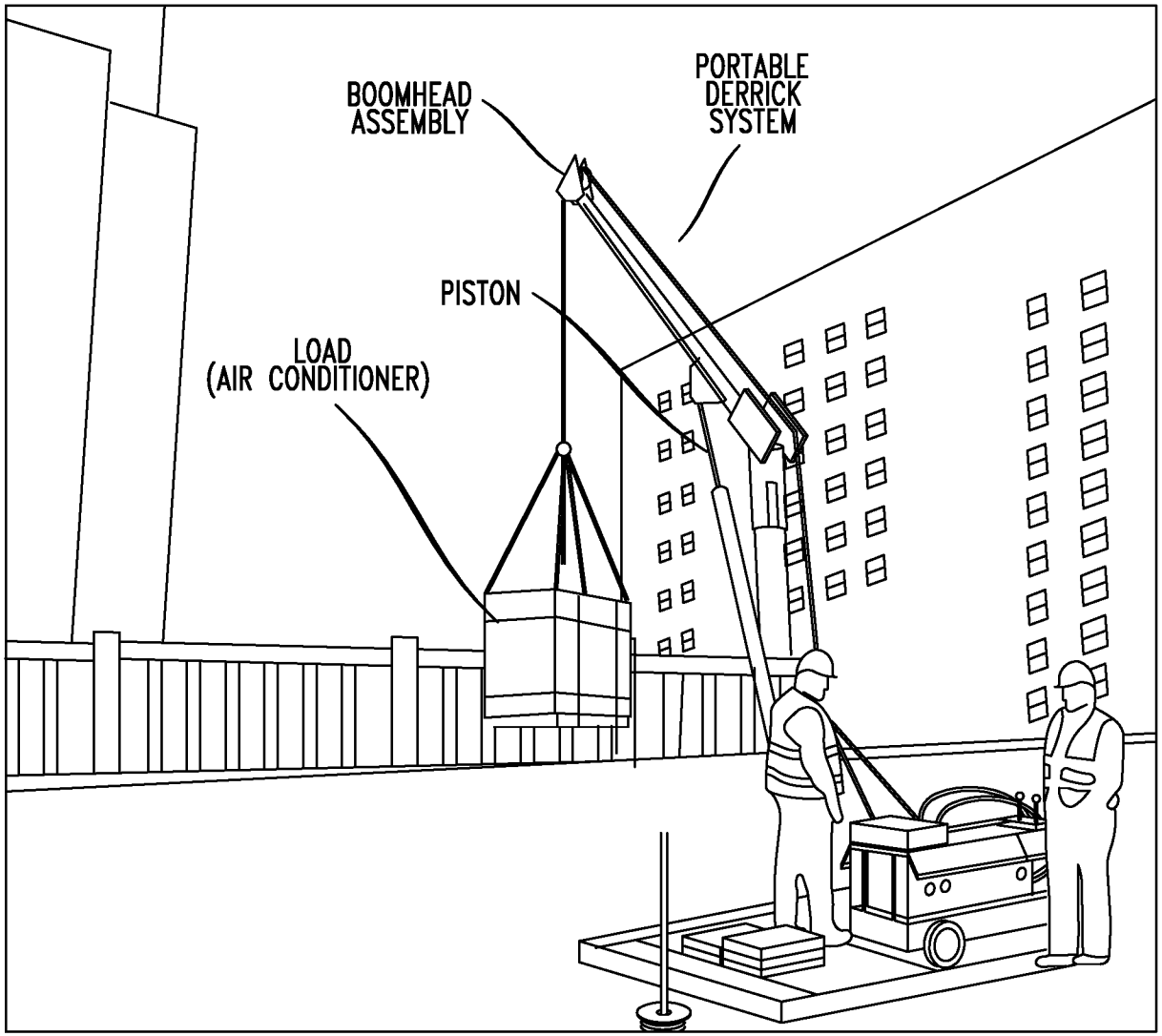
FIG. 30 is a photograph at a work site, wherein an air conditioner unit load is shown being hoisted using an embodiment of the portable derrick system according to the present invention, illustrated prior to its being rotated to a position above a resting place on the roof of this site.
Figure 31:
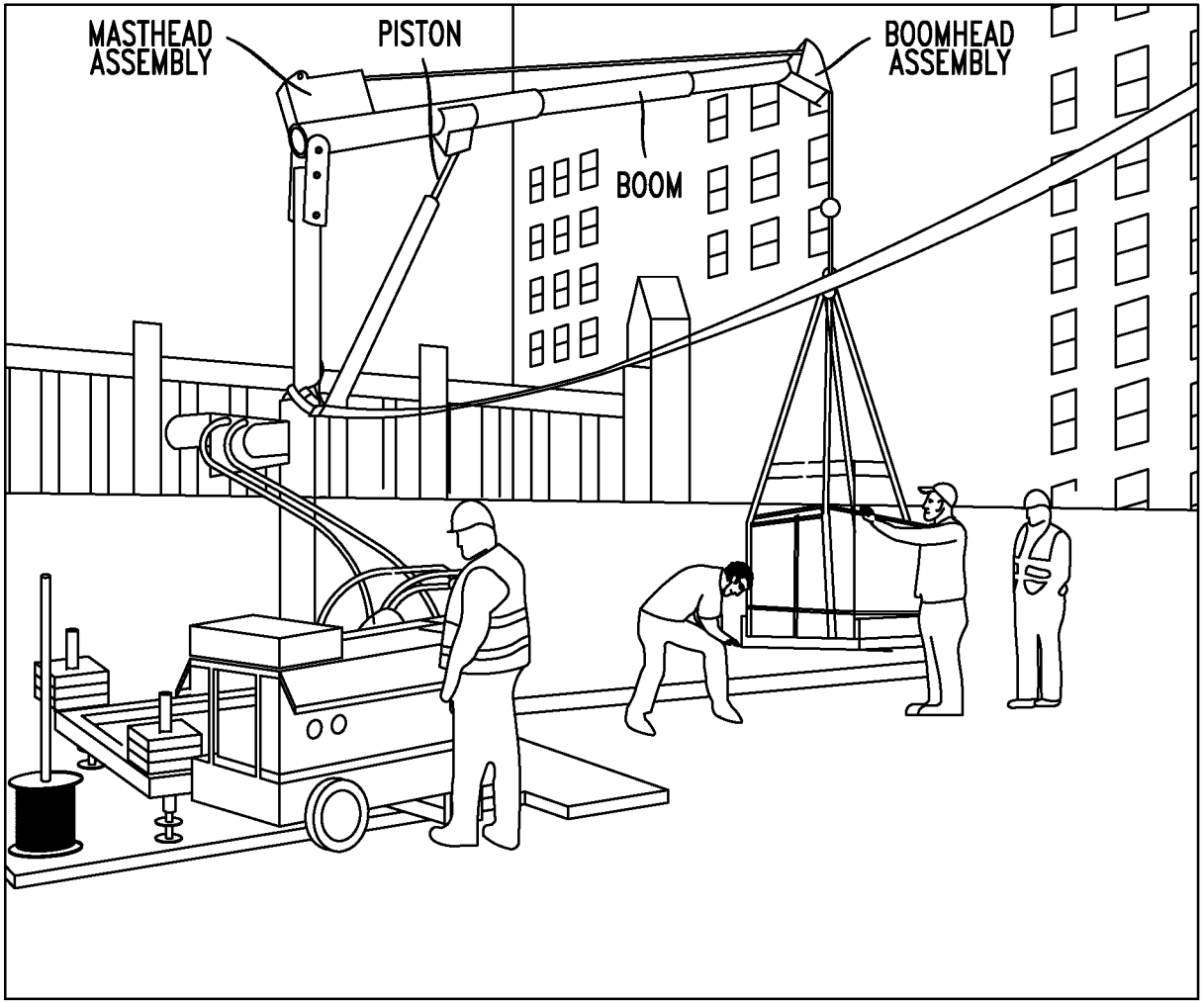
FIG. 31 is a photograph taken after that of FIG. 30, wherein the air conditioner load has substantially reached its rotation position, and the hydraulics operator is able to lower the load.
Figure 32:
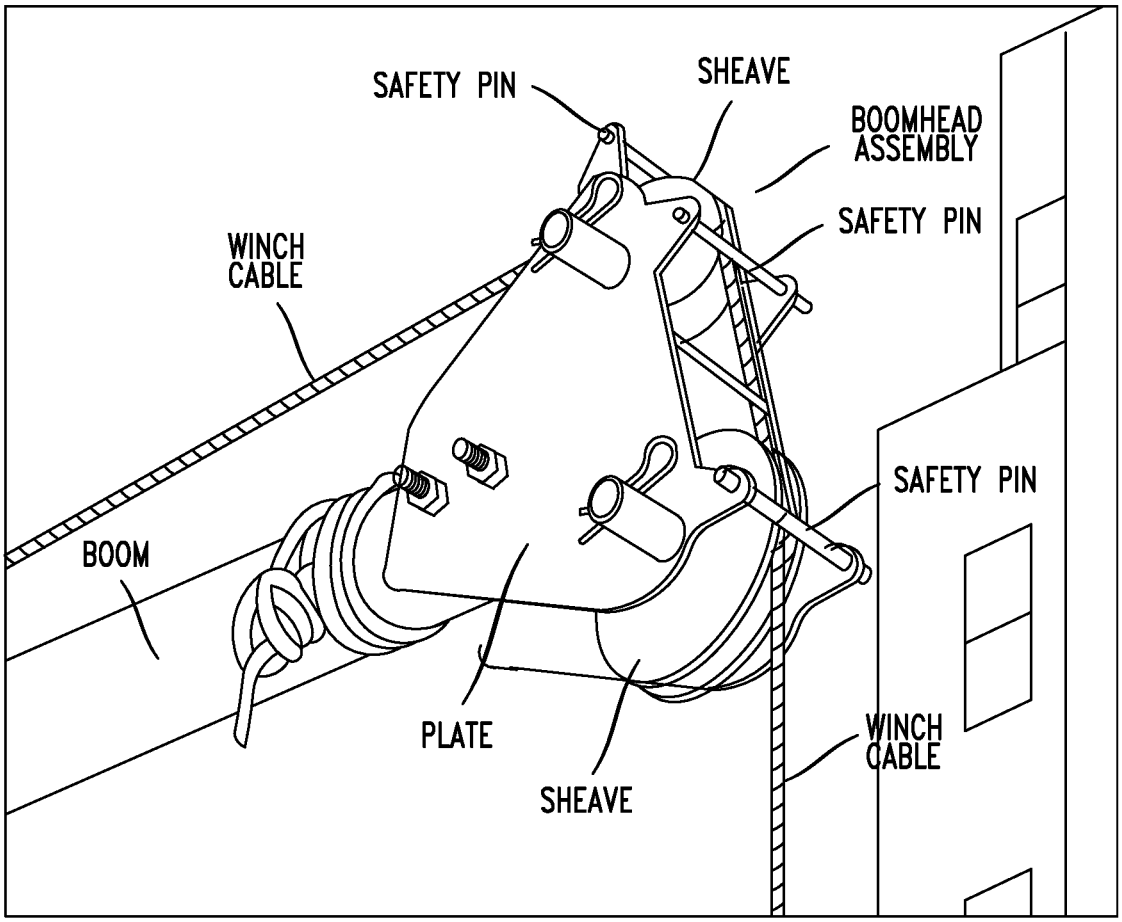
FIG. 32 is a photographic close up of the boomhead assembly, wherein two sheaves and their safety cable-retaining pins are clearly shown extending between spaced plates on either side of the end of the boom.
Figure 33:
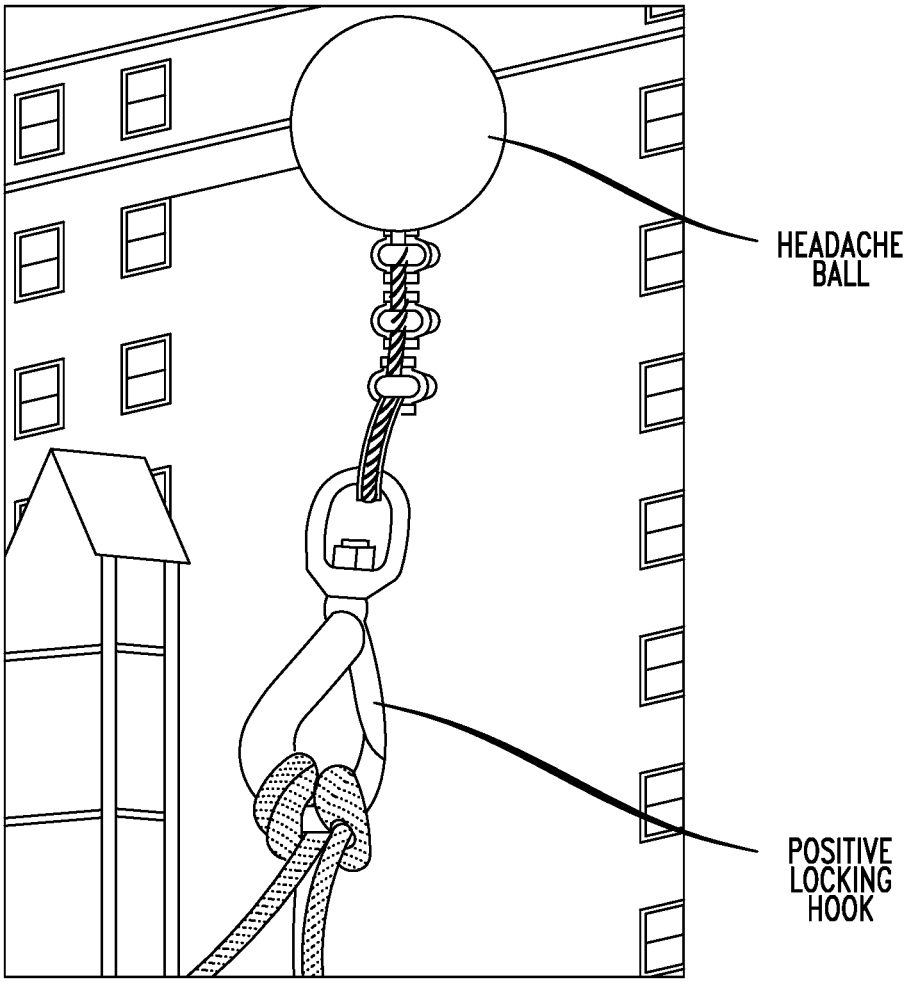
FIG. 33 is another photograph of a headache ball and positive-locking load-carrying hook, which closes upon itself under load, as a safety mechanism.
Figure 34:
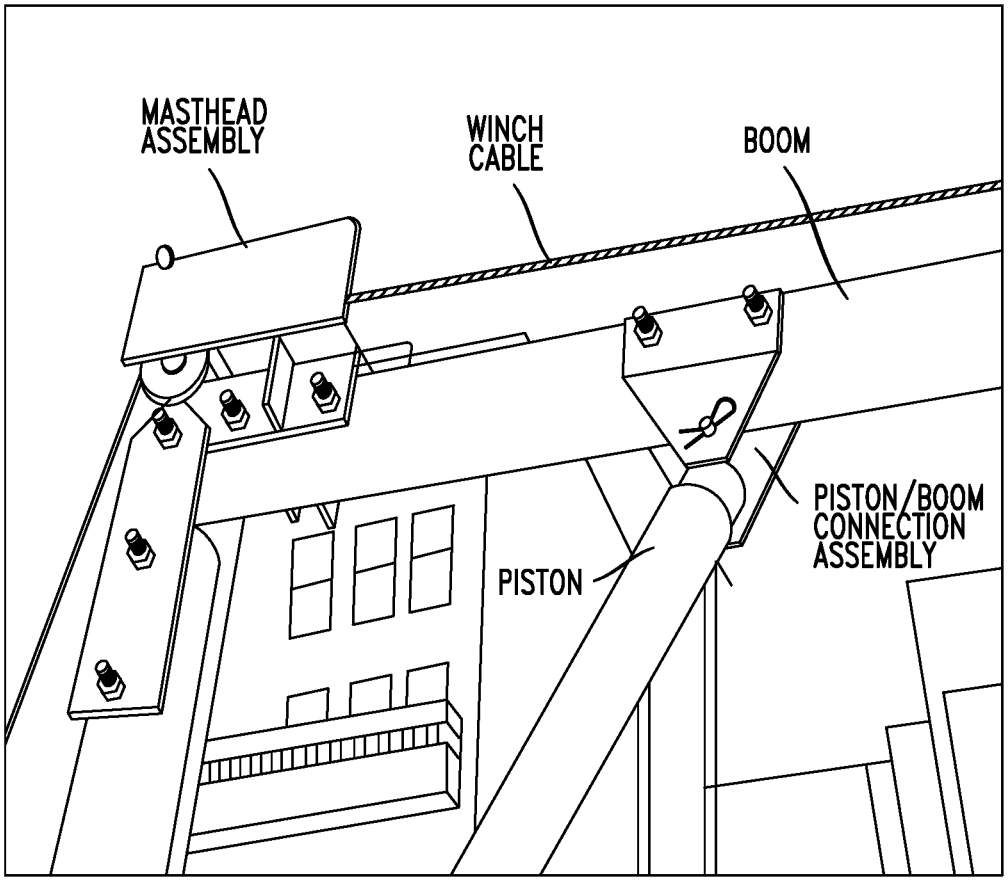
FIG. 34 is a photograph at the site of FIG. 30, wherein both the masthead and piston/boom assemblies are seen.
Figure 35:
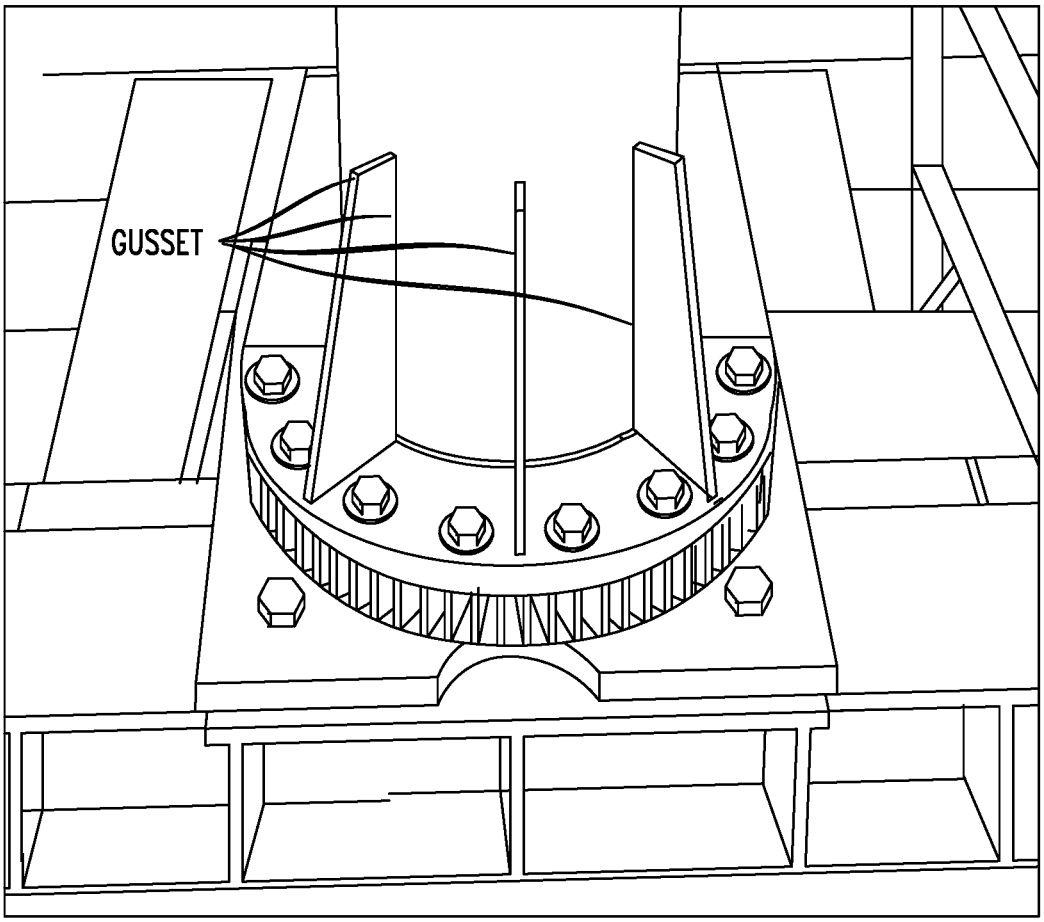
FIG. 35 is a relatively close up photograph of the horizontal turntable gear assembly which is engaged to swivel the boom of the present invention.
Figure 36:
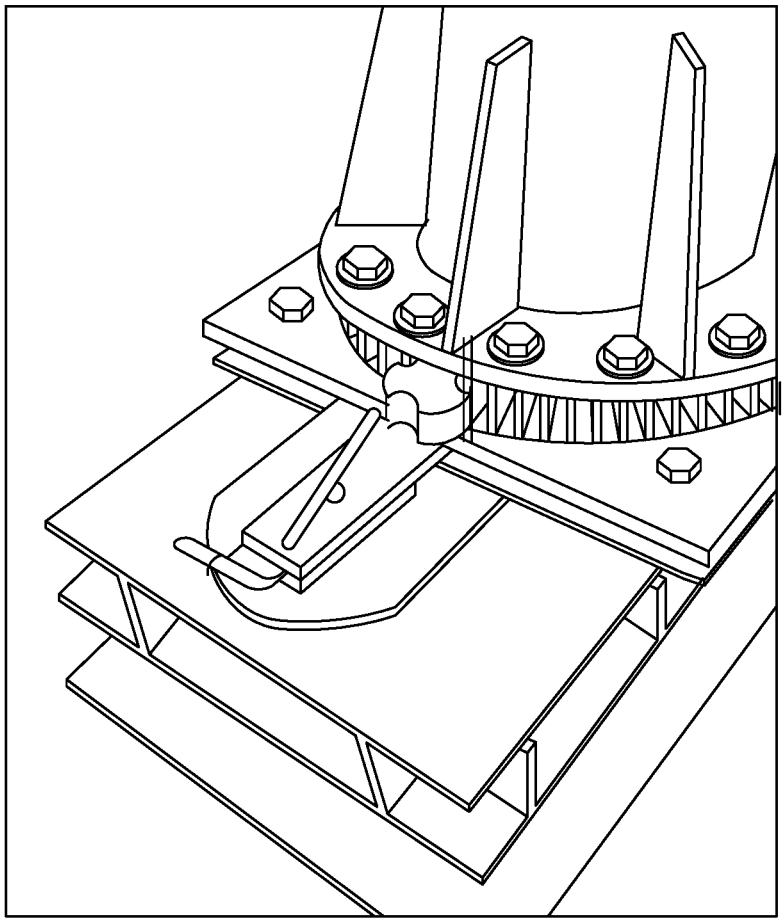
FIG. 36 is a photograph of a portion of the base assembly of the portable derrick system according to the present invention, wherein the viewer is able to see the post base with a horizontally disposed gear, locked from rotating by apparatus including a sliding subassembly which accepts a threaded locking bolt and handle.
Figure 37:
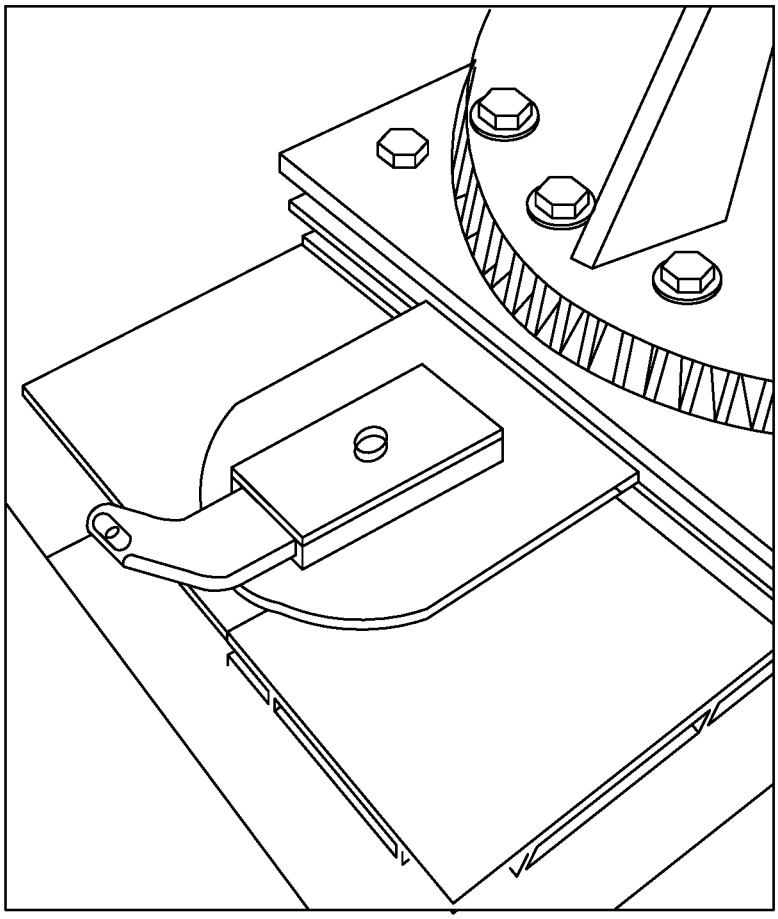
FIG. 37 is another photograph of the apparatus of FIG. 36, but with the locking bolt removed and the sliding subassembly pulled away from and disengaged from the horizontal gear, thereby permitting rotation thereof.

In earlier iterations of the present invention, in one of the preferred embodiments thereof, a mast base is configured to permit rotation of the mast and its associated boom manually. In FIG. 25, a manual swivel bar is shown extending outwardly horizontally from opposite sides of the mast. In this configuration, a person at one end of the bar, or two people at opposite ends of the bar, can rotate the mast and boom by pushing either clockwise or counter-clockwise about the mast centerline.

Figure 21:
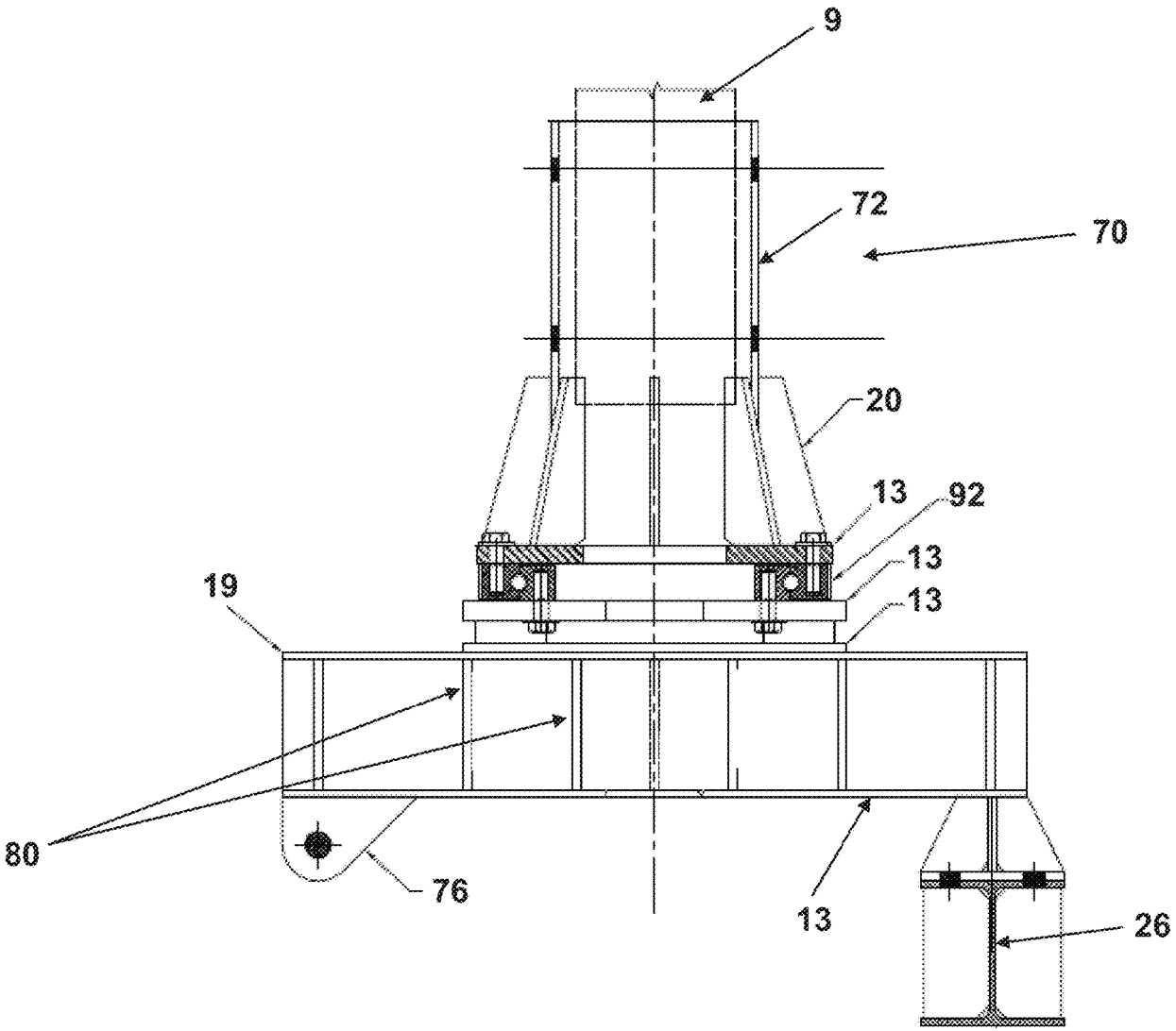
FIG. 21 is a side elevation view of a post base assembly of an embodiment of the portable derrick system according to the present invention.
Figure 21A:
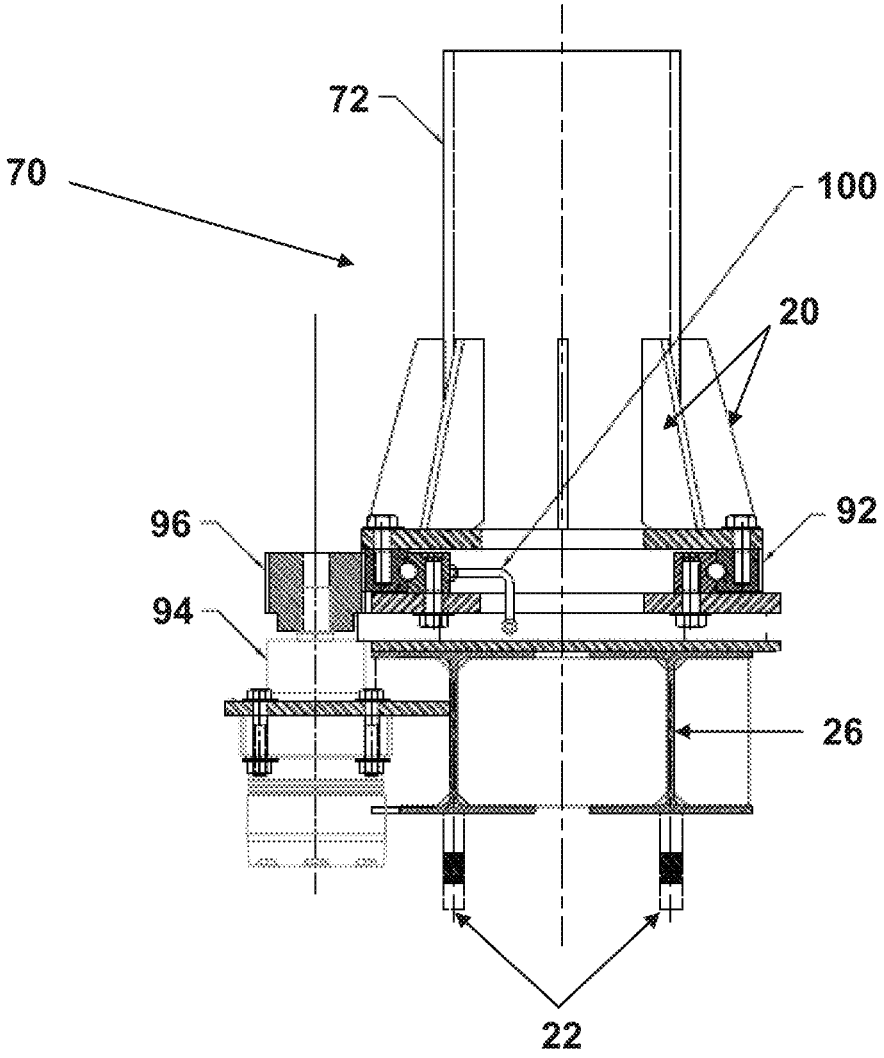
FIG. 21A is a sectional elevation view similar to FIG. 21 taken along the plane 21A-21A of FIG. 21B, but where the present invention is equipped with a motor-driven pinion gear which, cooperating with the gear of a turntable bearing, permits rotation of the mast and boom by means of a motor.
Figure 21B:
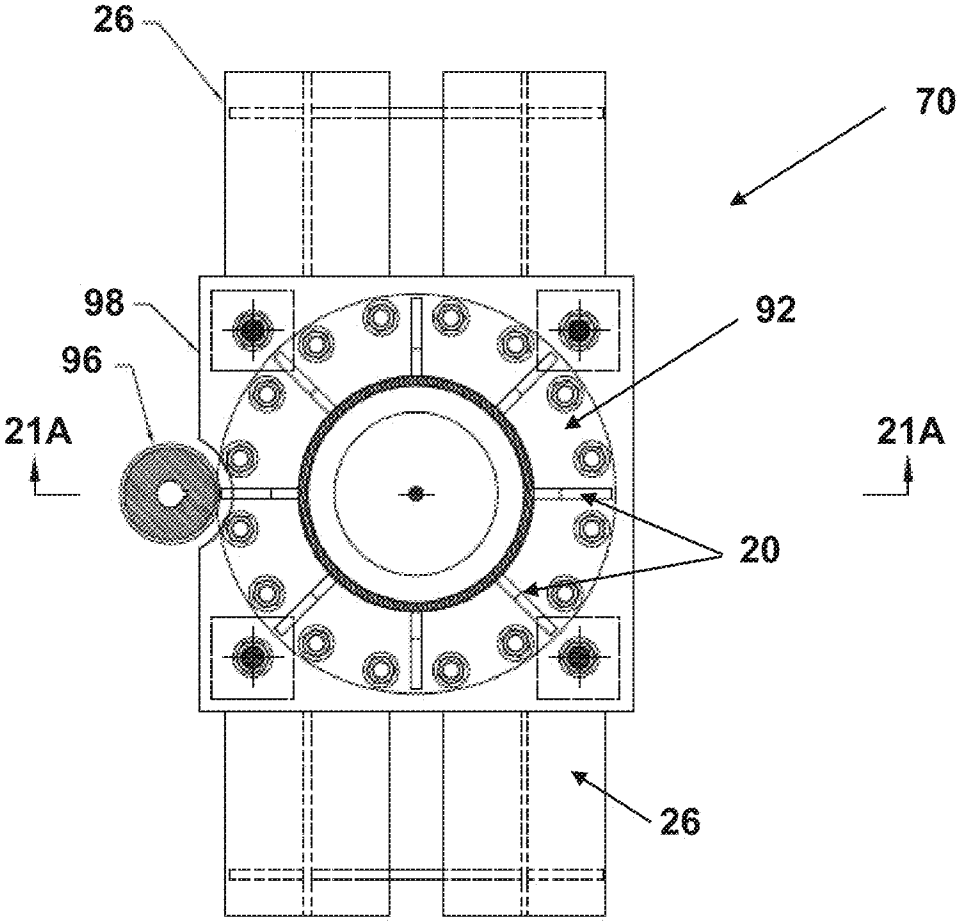
FIG. 21B is a plan view of the embodiment of the invention where it is equipped with a motor-driven pinion gear which, cooperating with the gear of a turntable bearing, permits rotation of the mast and boom by means of a motor.
Figure 22:
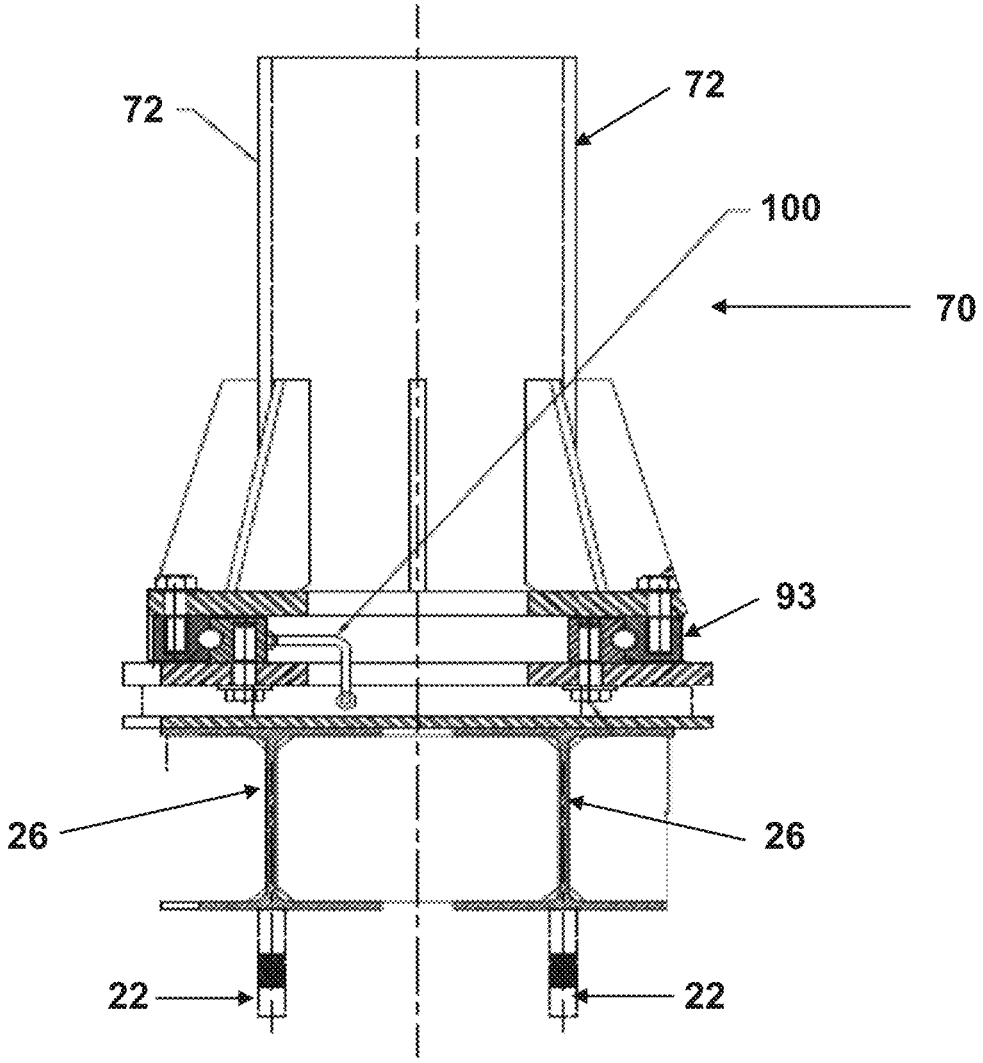
FIG. 22 is a sectional elevation view of the post base assembly.
Figure 23:
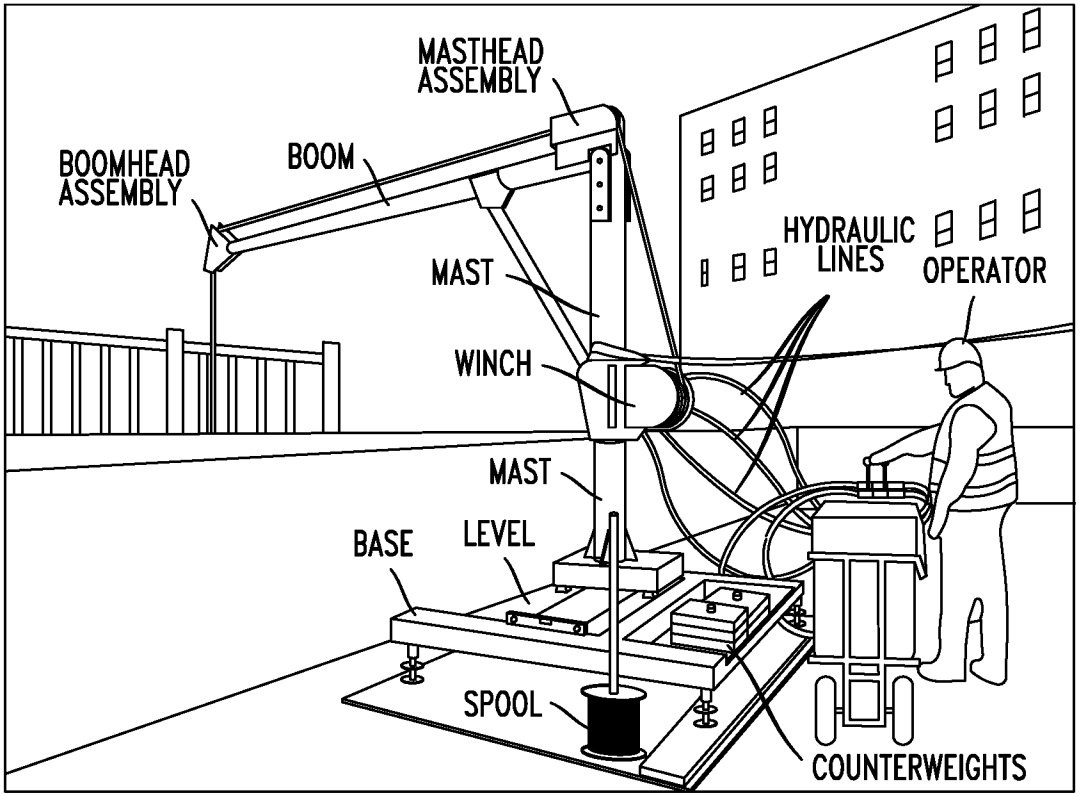
FIG. 23 is a photograph taken on the roof of a Manhattan, N.Y. site on which a portable derrick system according to the present invention has been assembled and is in operation lifting an air conditioner load being hoisted for installation at this site.
Figure 24:
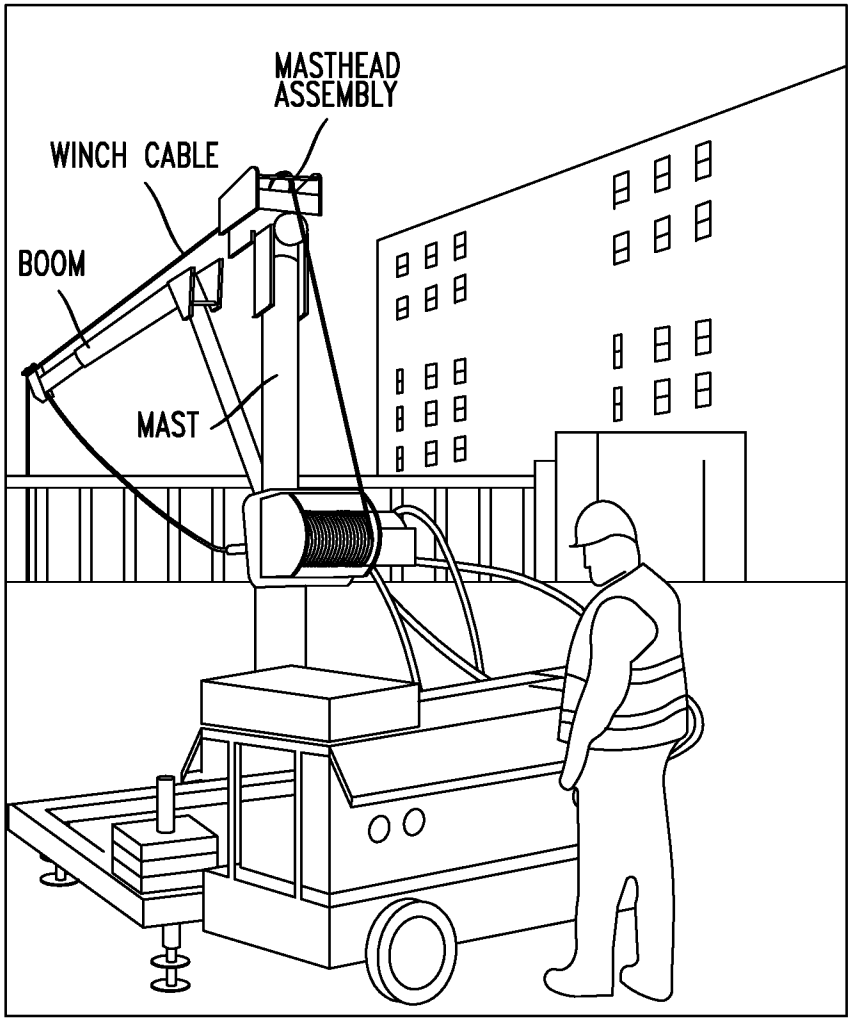
FIG. 24 is another photograph at the site of FIG. 23, taken from a different angle, with the lifting or hoisting in process and an operator at the hydraulic controls of embodiment of the portable derrick system according to the present invention.

In a later iteration of the present invention, in a preferred embodiment thereof, there is no need to have physical labor of one or more persons rotate the mast and boom. Instead, in FIGS. 21A, 21B and 22 a turntable 90 is provided with a turntable bearing 92, which permits relatively easy rotation of the mast and boom. In place of physical labor, the central shaft or an extension thereof of a hydraulic motor 94 is fitted with a pinion gear 96 disposed in cooperative meshed relationship with the outwardly extending gear teeth of turntable 90. Operation of the motor 94 in either direction will cause a resulting rotation of the pinion gear 96, which in turn drives the gear of the turntable 90. Mast base (described above) 70 includes a bottom plate 98 which is bolted to one side of the turntable bearing, while the opposite side of the turntable bearing is affixed to the beam supporting structure shown. A grease fitting 100 is shown in FIGS. 21A and 22.

FIGS. 23-37 are photographs taken during the present invention's use in hoisting an air conditioner load from street level to the roof of a New York building. The reader will recognize in these photographs the components of the present invention discussed with respect to FIGS. 1-22. The system according to the present invention shown in these photographs is the embodiment which uses physical labor to rotate the mast and boom, as opposed to the invention embodiment in which an hydraulic motor and pinion gear are used to accomplish this.

In this way, the present invention can be provided with either manual or motor-driven rotating ability. The addition of the pinion gear driving motor does not add excessive weight to the overall weight of the components of the present invention to make it undesirable.

Another point worth mentioning here relates to the same rooftop photographs which show the power unit, motor and hydraulics assembly units carried within a single frame. It is within the scope of the present invention, for portability, to separate these components so that lighter weight components can be more easily carried to the rooftop (for example) by utilizing more trips to and from the roof. This becomes a factor when one considers that elevators do not normally go as high as the rooftop, and the components will be carried up and down steps of at least one flight from the elevator landing to the rooftop. Other features will become obvious from the drawings and are not spelled out in detail within this provisional patent application.

Note re Individuals Shown: The faces of individuals have been deliberately obscured to preserve their privacy.

No effort has been made to label each component within each photograph, in view of the duplicative nature of the photographs. And the system according to the present invention utilizes hydraulic motors and means, illustrated in the photographs of FIGS. 23-37, with hydraulic lines interconnecting critical components such as the piston/cylinder assembly used to raise/lower the boom. Reference characters have not been assigned to the various hydraulic lines best seen in the photographs. The following additional information may be helpful to the reader:

The overall weight of the derrick will be 8500 pounds to lift a load of 2000 pounds.

There is a load chart that may be generated which will provide the user of the present invention with the boom radius, the angle of the boom from horizontal, and the preferred counterweight magnitude for varying weight of loads. It is my present intention to provide this information in a non-provisional patent application which will obtain the benefit of the filing date of this provisional application.

As the boom is raised to different angles, the amount of counterweights may thus be calculated and determined. As the weight of the load decreases, the amount of counterweights will decrease, obviously.

The "footprint" of the assembled portable derrick system according to the present invention is preferably 92 inches by 92 inches. This small footprint enables its use on balconies, terraces and smaller rooftops. This small footprint comprises an element of this design, and permits avoiding highly difficult setups and operations. Furthermore, the same footprint is available using my invention for any loads up to 2000 pounds.

The portable derrick system of the present invention is truly "passive" in that it is not invasive to the building on which it is used. There is no need to tie the apparatus to the building, since this invention is free standing, portable, and uses counterweights.

Safety pins associated with each sheave prevent the winch cable from jumping out of the sheave grooves.

Lighter loads associated with the components of the present invention will avoid heavy duty-cycle use of buildings' service elevators. This benefits everyone in the building, since there is less wear and tear.

Water tower companies will "love" the present invention because their tower components will not have to fit within or on an elevator. Beams typically running 32 feet in length may be easily raised, and partial lengths will no longer require being welded together to achieve the design lengths. Furthermore, this eliminates associated work such as burning and welding on the roof.

The importance of being able to hoist during normal working hours Monday through Friday cannot be overemphasized. With present crane arrangements, one is limited to some 4 weekends (Saturdays) a month. With the portable derrick system of the present invention, one enjoys 20 working days a month for hoisting. Resident managers no longer have to begin a job on a Saturday or Sunday.

In New York City, there is a "crane embargo" in effect from November 22 through the first Monday of the New Year. This is the Christmas holiday shopping season. Except for emergencies, such as in the case of a hospital generator, for example, there is no shutting down of streets, no closing of sidewalks, and perceived safety is increased without interfering with spenders' habits. The present invention is not affected by the crane embargo, thereby opening up many delivery and hoisting days.

When discussing winds and the problems high winds present for crane operation, it is usually during the month of October that winds increase in intensity. Preparations are truly designed for no-wind or minimal-wind days. During times of higher winds, there can be a kite-like effect on the profile of loads being lifted. 25 mile per hour winds are the cutoff point for safety and closedown of crane operations. Of course, loss of hoisting days in the rigger's allowed time window of the permit may/will require re-application for a new or extended permit time window. With the present invention, during days of inclement weather, high winds, heavy rain, snow, the portable derrick system of the present invention can simply sit unused on a rooftop, with no rain or wind damage to artwork. With the present invention, one simply needs to wait for better weather, and there need be no activity at street level.

Conclusion:

The portable derrick system of the present invention eliminates many state of the art existing problems, and provides many benefits—a win-win for those wishing to utilize the invention. While embodiments of the invention disclosed herein are specific, as shown in the drawings and photographs, and while a hypothetical illustrative example has been given for New York City, the present invention contemplates uses in locations throughout the world, and contemplates variations and other embodiments coming within the spirit and scope of my invention, and it is not to be improperly or unduly limited.

What is claimed is:

1. A portable derrick system for use in hoisting and lowering loads at a plurality of job sites, comprising, in combination:

a mast base, a mast removably interconnected to the mast base at a first lower end and extending vertically upwardly from the mast base, a multiple-sectioned boom assembly comprising a plurality of interlocking boom sections slidably connected to each other with a plurality of connecting pins, the plurality of interlocking boom sections comprising a smaller boom section, a larger boom section, and a largest boom section, a boomhead assembly, a masthead sheave assembly, wherein the masthead sheave assembly is removably interconnected to the largest boom section at a first end of the boom assembly and the boomhead assembly is removably interconnected to the smaller boom section at a second end of the boom assembly, and wherein the mast is removably interconnected at a second upper end to the first end of the boom assembly, a piston/cylinder assembly in which a piston is slidably engaged within the cylinder, a piston/boom connecting assembly removably and pivotally interconnecting a first end of the piston/cylinder assembly to the boom assembly, a piston/base connecting assembly removably interconnecting a second end of the piston/cylinder assembly to the mast, and a winch assembly removably interconnected to and supported by the piston/base connecting assembly, the winch assembly comprising a winch cable wound around a spool and which, when unspooled therefrom, extends around first roller bearing sheaves mounted on the masthead sheave assembly, along the boom assembly, and around second roller bearing sheaves mounted on the boomhead assembly, wherein a load-carrying hook is interconnected to an end of the winch cable for supporting a load therefrom.

2. The portable derrick system of claim 1 wherein the mast is removably interconnected at a second upper end to the first end of the boom assembly with a pair of connecting plates located on opposite sides of the mast and the boom assembly, and wherein the connecting plates removably interconnect the mast with the boom assembly with a plurality of threaded rods inserted therethrough.

3. The portable derrick system of claim 1 wherein the boomhead assembly comprises a pair of plates oppositely disposed around the second end of the boom assembly and is removably interconnected to the second end of the boom assembly with a pair of removable threaded rods that extend through openings in the plates and the boom assembly.

4. The portable derrick system of claim 1 wherein the piston/base connecting assembly comprises a pair of substantially vertically extending side plates joined by a connecting plate, a ring plate, and a plate, to form box-like structure around the mast, wherein the side plates comprise a plurality of openings in which a plurality of threaded rods are inserted to connect the side plates to the mast through a matching plurality of openings in the mast.

5. The portable derrick system of claim 4 wherein the piston/base connecting assembly further comprises a pipe spacer inserted through openings in the side plates and the piston/cylinder assembly to removably interconnect the second end of the piston/cylinder assembly to the mast.

6. The portable derrick system of claim 4 wherein the piston/base connecting assembly further comprises a pair of angle plates mounted to the pair of side plates, wherein the winch assembly is removably interconnected to and supported by the pair of angle plates on the piston/base connecting assembly.

7. The portable derrick system of claim 1 wherein the piston/boom connecting assembly comprises a pair of plates, each comprising a plurality of openings, wherein the plates are oppositely disposed the boom assembly and a plurality of threaded rods interconnect the pair of plates with the boom assembly and the first end of the piston/cylinder assembly.

8. The portable derrick system of claim 1 wherein the mast is mounted on a turntable and a turntable bearing, and further comprising a hydraulic motor and a pinion gear disposed in cooperative meshed relationship with a set of outwardly extending gear teeth of the turntable, wherein operation of the hydraulic motor in either direction will cause a resulting rotation of the pinion gear which in turn drives the gear of the turntable.

* * * * *